US007387117B2

(12) United States Patent
Kunimoto

(10) Patent No.: US 7,387,117 B2
(45) Date of Patent: Jun. 17, 2008

(54) GAS POWERED TOY GUN

(75) Inventor: Kenichi Kunimoto, Shibuya-ku (JP)

(73) Assignee: Western Arms, Tokyo (JP)

( * ) Notice: Subject to any disclaimer, the term of this patent is extended or adjusted under 35 U.S.C. 154(b) by 338 days.

(21) Appl. No.: 10/885,954

(22) Filed: Jul. 8, 2004

(65) Prior Publication Data

US 2005/0064782 A1 Mar. 24, 2005

(30) Foreign Application Priority Data

Jul. 29, 2003 (JP) ..... 2003-281474

(51) Int. Cl.
*F41B 11/32* (2006.01)

(52) U.S. Cl. ..... 124/73; 124/76

(58) Field of Classification Search ..... 124/71–76
See application file for complete search history.

(56) References Cited

U.S. PATENT DOCUMENTS 3,420,220 A * 1/1969 Ferrando ..... 124/71
5,383,442 A * 1/1995 Tippmann ..... 124/76
5,476,087 A * 12/1995 Kunimoto ..... 124/73
5,477,843 A * 12/1995 Kunimoto ..... 124/73
5,509,399 A * 4/1996 Poor ..... 124/76
5,655,510 A * 8/1997 Kunimoto ..... 124/81
5,664,552 A * 9/1997 Kunimoto ..... 124/73
5,711,286 A * 1/1998 Petrosyan et al. ..... 124/73
6,073,620 A * 6/2000 Kunimoto ..... 124/74
6,112,734 A * 9/2000 Kunimoto ..... 124/73
6,158,424 A * 12/2000 Kunimoto ..... 124/73
6,497,229 B1 * 12/2002 Maeda ..... 124/76

(Continued)

FOREIGN PATENT DOCUMENTS

EP 0647825 4/1995

(Continued)

*Primary Examiner*—Michael J. Carone
*Assistant Examiner*—Stewart T Knox
(74) *Attorney, Agent, or Firm*—Studebaker & Brackett PC; Donald R. Studebaker

(57) ABSTRACT

A gas powered toy gun comprises a gas supplying portion from which a gas leading passage extends, a valve for controlling the gas leading passage to be open and closed selectively, a slider provided to be movable to a barrel portion connected with a bullet holding chamber and provided with a pressure receiving portion for moving backward in order to supply the bullet holding chamber with a sham bullet, a movable member having an inner space formed therein and provided to be movable in the slider so as to be put selectively in a first state wherein the inner space is coupled with the gas leading passage and in a second state wherein the inner space is removed from the gas leading passage for guiding gas flowing through the gas leading passage to the bullet holding chamber through the inner space so that the sham bullet put in the bullet holding chamber is shot with pressure of gas acting thereon and for guiding further the gas flowing through the gas leading passage to the pressure receiving portion through the inner space so that the slider is moved backward with pressure of gas acting on the pressure receiving portion, and gas flow adjusting means provided in the inner space formed in the movable member for adjusting the amount of gas flowing through the inner space to the pressure receiving portion in response to pressure of gas led into the inner space.

2 Claims, 19 Drawing Sheets

U.S. PATENT DOCUMENTS

| | | | | |
|---|---|---|---|---|
| 6,502,568 | B2 * | 1/2003 | Kunimoto | 124/73 |
| 6,810,870 | B1 * | 11/2004 | Hu | 124/76 |
| 7,033,175 | B2 * | 4/2006 | Kunimoto | 434/18 |
| 2002/0170552 | A1 * | 11/2002 | Gardner | 124/56 |
| 2003/0047175 | A1 * | 3/2003 | Farrell | 124/76 |
| 2004/0089280 | A1 * | 5/2004 | Kunimoto | 124/76 |
| 2005/0011508 | A1 * | 1/2005 | Kunimoto | 124/73 |
| 2005/0064782 | A1 * | 3/2005 | Kunimoto | 446/210 |
| 2006/0112944 | A1 * | 6/2006 | Su | 124/71 |
| 2006/0162711 | A1 * | 7/2006 | Maeda et al. | 124/73 |
| 2006/0169265 | A1 * | 8/2006 | Lai | 124/71 |

FOREIGN PATENT DOCUMENTS

| | | |
|---|---|---|
| GB | 26146 | 7/1912 |
| JP | 7-103694 | 4/1995 |

* cited by examiner

GAS POWERED TOY GUN

BACKGROUND OF THE INVENTION

1. Field of the Invention

The present invention relates generally to a gas powered toy gun, and more particularly to an improvement in a toy gun, in which the shooting of a sham bullet put in a bullet holding chamber and the backward movement of a slider for supplying the bullet holding chamber with the next sham bullet are carried out by means of pressure of gas.

2. Description of the Prior Art

A toy gun which utilizes gas pressure, namely, pressure brought about by air or gas other than air is usually made to imitate a real gun in not only its color and shape but also its apparent operations. As one of these toy guns utilizing gas pressure, it has been proposed a gas powered toy gun in which a pressure accumulating chamber is formed in a grip to be filled with compressed gas and a gas passage extending from the pressure accumulating chamber is opened, by means of the rotation of a hammer linked with a trigger to operate in response to the movement of the trigger, to supply a bullet holding chamber with the gas discharging from the pressure accumulating chamber to be used for shooting a sham bullet put in the bullet holding chamber, or a pressure accumulating chamber is formed in a grip to be filled with compressed gas and the gas discharging from the pressure accumulating chamber is supplied through a gas passage extending from the pressure accumulating chamber to be used not only for shooting a sham bullet put in a bullet holding chamber but also for causing a slider provided to be movable along a barrel to move backward so that the bullet holding chamber having been made empty is supplied with the next sham bullet by the slider moving forward after its backward movement, as shown in, for example, Japanese patent application published before examination under publication number HEI 7-103694.

The gas powered toy gun thus proposed previously is provided with, in addition to the pressure accumulating chamber formed in the grip, the gas passage extending from the pressure accumulating chamber and the slider, a movable member in which a bullet shooting gas passage, a bullet supplying gas passage, a center space connecting the bullet shooting gas passage and the bullet supplying gas passage with each other, and a common gas passage extending from the center space are formed. In such a gas powered toy gun, when the gas passage extending from the pressure accumulating chamber is made open by means of the rotation of a hammer linked with a trigger to operate in response to the movement of the trigger, the gas discharging from the pressure accumulating chamber is led through the gas passage made open into the movable member. The gas led in the movable member flows into one or both of the bullet shooting gas passage and the bullet supplying gas passage in accordance with the position of a gas passage controller contained to be movable in the movable member. The gas flowing into the bullet shooting gas passage in operative to cause pressure of gas to act on the sham bullet put in the bullet holding chamber for shooting the same. The gas flowing into the bullet supplying gas passage is operative to cause pressure of gas to act on the slider for moving the same backward. With the backward movement of the slider, the movable member is also moved backward together with the slider. Although the gas passage extending from the pressure accumulating chamber is shifted to be closed from open with the backward movement of the slider so that the supply of the gas from the pressure accumulating chamber is stopped, the slider continues to move backward with inertia after the gas passage is shifted to be closed so as to reach to the most retreated position. Then, the slider turns to move forward with energizing force exerted by a spring when having arrived at the most retreated position. With the forward movement of the slider, the movable member is also moved forward together with the slider. With the backward and forward movements of the movable member performed as mentioned above, one of sham bullets contained in a magazine is pushed up to be held at the upper end portion of the magazine and then the sham bullet held at the upper end portion of the magazine is carried toward the bullet holding chamber, so that the bullet holding chamber which has been made empty is supplied with the next sham bullet.

In such a gas powered toy gun as mentioned above, in which the shooting of the sham bullet put in the bullet holding chamber and the movement of the slider are carried out by means of the pressure of gas, it is desired that the pressure of gas used for moving the slider backward is maintained to have a pressure value for causing the slider to move at an appropriate speed so as to reach to the most retreated position. However, in order to attach great importance to easy handling, safety and so on, the gas used for the gas powered toy gun is usually selected to be low-pressure liquefied gas which varies in its pressure on a relatively large scale in response to temperature variations, and therefore it is feared that disadvantages or problems on the backward movement of the slider are brought about with variations in atmospheric temperature. For example, in a season of relatively high atmospheric temperature, the pressure of gas used for moving the slider backward has such a high pressure value as to causing the slider to move at an extremely high speed toward the most retreated position and, as a result, an excessive mechanical shock is caused when the slider reaches to the most retreated position. In this case, it is feared that a body of the gas powered toy gun is destroyed with repetition of such excessive mechanical shock as mentioned above. Further, in a season of relatively low atmospheric temperature, the pressure of gas used for moving the slider backward has such a low pressure value as to be insufficient for causing the slider to reach to the most retreated position and, as a result, it is feared that the movable member can not move appropriately.

Under the circumstances as mentioned above, in the gas powered toy gun wherein the shooting of the sham bullet put in the bullet holding chamber and the movement of the slider for supplying the bullet holding chamber which has been made empty with the next sham bullet are carried out by means of the pressure of gas, it is strongly desired that the pressure of gas used for moving the slider backward is maintained to have a pressure value for causing the slider to move appropriately regardless of changes of seasons. However, any previously proposed gas powered toy gun arranged to meet the requirement has not been found.

OBJECTS AND SUMMARY OF THE INVENTION

Accordingly, it is an object of the present invention to provide a gas powered toy gun, in which the shooting of a sham bullet put in a bullet holding chamber and the movement of a slider for supplying the bullet holding chamber which has been made empty with the next sham bullet are carried out by means of pressure of gas, and which voids the aforementioned disadvantages encountered with the prior art.

Another object of the present invention is to provide a gas powered toy gun, in which the shooting of a sham bullet put in a bullet holding chamber and the movement of a slider for supplying the bullet holding chamber which has been made empty with the next sham bullet are carried out by means of pressure of gas, and the pressure of gas used for moving the slider backward is maintained to have a pressure value for causing the slider to move at an appropriate speed regardless of variations in atmospheric temperature.

According to the present invention, as claimed in any one of claims 1 to 7, there is provided a gas powered toy gun, which comprises a gas supplying portion from which a gas leading passage extends, a valve for controlling the gas leading passage to be open and closed selectively, a slider provided to be movable to a barrel portion connected with a bullet holding chamber in which a sham bullet is put and provided with a pressure receiving portion fixed to be positioned at the back of the barrel portion for moving backward in order to supply the bullet holding chamber with the sham bullet, a movable member having an inner space formed therein and provided to be movable in the slider so as to be put selectively in a first state wherein the inner space is coupled with the gas leading passage and in a second state wherein the inner space is removed from the gas leading passage for guiding gas flowing through the gas leading passage to the bullet holding chamber through the inner space so that the sham bullet put in the bullet holding chamber is shot with pressure of gas acting thereon and for guiding further the gas flowing through the gas leading passage to the pressure receiving portion through the inner space so that the slider is moved backward with pressure of gas acting on the pressure receiving portion in the first state when the valve is operative to control the gas leading passage to be open, and gas flow adjusting means provided in the inner space formed in the movable member for adjusting the amount of gas flowing through the inner space to the pressure receiving portion in response to pressure of gas led into the inner space through the gas leading passage.

Especially, in one embodiment of gas powered toy gun according to the present invention, as claimed in claim 2, the gas flow adjusting means is operative to limit the amount of gas flowing through the inner space to the pressure receiving portion when the pressure of gas led into the inner space through the gas leading passage has a value not less than a predetermined value.

In the gas powered toy gun thus constituted in accordance with the present invention, the amount of gas flowing through the inner space to the pressure receiving portion is adjusted by the gas flow adjusting means provided in the inner space formed in the movable member in response to the pressure of gas led into the inner space through the gas leading passage. The adjustment of the amount of gas by the gas flow adjusting means is performed, for example, in such a manner that the amount of gas flowing through the inner space to the pressure receiving portion is limited when the pressure of gas led into the inner space through the gas leading passage has the value not less than the predetermined value, as in one embodiment of the present invention claimed in claim 2. With such adjustment, the gas flowing through the inner space formed in the movable member to the pressure receiving portion for causing the slider to move backward is adjusted to be appropriate in the amount thereof in response to its pressure, for example, in such a manner that the amount is reduced when the pressure is too high, and thereby the slider can be moved backward at an appropriate speed with the gas acting on the pressure receiving portion.

The pressure of gas led into the inner space formed in the movable member varies, for example, in response to variations in atmospheric temperature and a situation wherein the pressure of gas led into the inner space becomes equal to or more than a predetermined value can be induced in response to the atmospheric temperature. Accordingly, with the gas powered toy gun according to the present invention, in which the gas flowing through the inner space formed in the movable member toward the pressure receiving portion is adjusted to be appropriate in the amount thereof in response to the pressure of gas led into the inner space through the gas leading passage and thereby the slider can be moved backward at an appropriate speed with the gas acting on the pressure receiving portion, the pressure of gas used for moving the slider backward is maintained to have a pressure value for causing the slider to move backward at the appropriate speed regardless of variations in atmospheric temperature. Accordingly, the gas powered toy gun according to the present invention is able to avoid both of such a disadvantage in a season of relatively high atmospheric temperature that an excessive mechanical shock is caused when the slider reaches to the most retreated position and it is feared that a body of the toy gun is destroyed with repetition of the excessive mechanical shock and such a disadvantage in a season of relatively low atmospheric temperature that the pressure of gas used for moving the slider backward has such a low pressure value as to be insufficient for causing the slider to reach to the most retreated position and it is feared that the movable member can not move appropriately.

The above, and other objects, features and advantages of the present invention will become apparent from the following detailed description taken in conjunction with the accompanying drawings.

DESCRIPTION OF THE PREFERRED EMBODIMENTS

Figure 1:
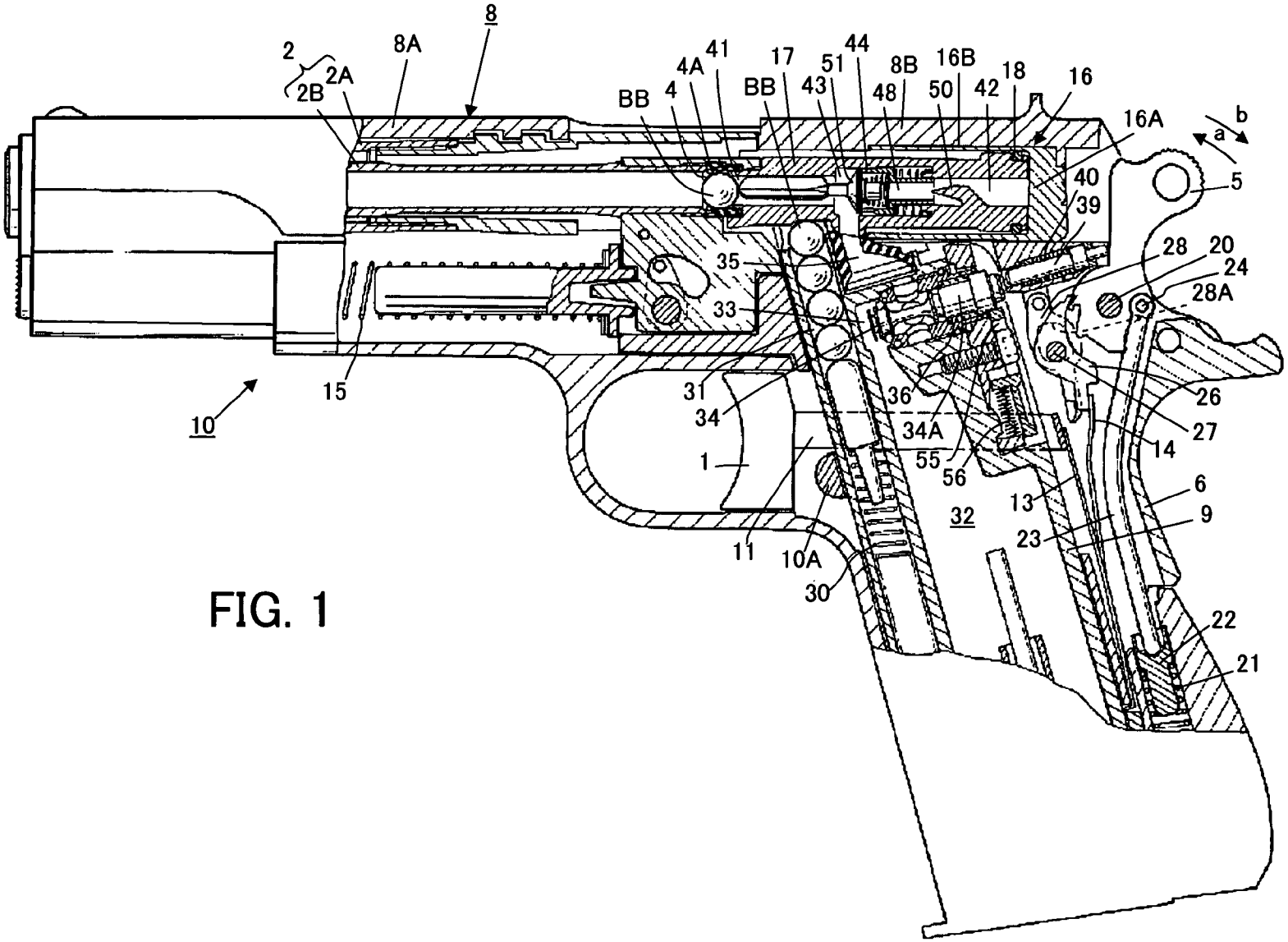
FIG. 1 is a partially cross sectional view showing a first embodiment of gas powered toy gun according to the present invention.

FIG. 1 shows a first embodiment of gas powered toy gun according to the present invention.

Referring to FIG. 1, the first embodiment of gas powered toy gun according to the present invention has a body 10 in which a trigger 1, a barrel portion 2 constituted with an outer barrel 2A and an inner barrel 2B, a bullet holding chamber 4, a hammer 5 and a grip 6 are provided, a case 9 held to be detachable in the grip 6, and a slider 8 provided to be movable along the barrel portion 2. For the sake of convenience in explanation, hereinafter, a side of a muzzle provided on the barrel portion 2 of the first embodiment shown in FIG. 1 is referred to a front or forward side and a side of the hammer 5 of the first embodiment shown in FIG. 1 is referred to a rear or backward side. For example, the bullet holding chamber 4 is positioned on a rear end of the barrel portion 2 and the slider 8 is able to move forward and backward along the barrel portion 2.

The bullet holding chamber 4 positioned on the rear end of the barrel portion 2 is formed in a tubular member 4A which is made of elastic frictional material, such as rubber, and put in the rear end portion of the inner barrel 2B. With the structure thus constituted, the barrel portion 2 including the inner barrel 2B is connected with the bullet holding chamber 4.

In the grip 6, a movable bar member 11 extending backward from the trigger 1 is provided to be movable in the direction along the barrel portion 2. When triggering, the trigger 1 is moved backward from an operational initial position in front of a contact portion 10A provided on the body 10 and the movable bar member 11 is also moved backward together with the trigger 1. A leaf spring 13 is in contact with a rear end portion of the movable bar member 11 for exerting energizing force to push the movable bar member 11 in the forward direction. Accordingly, the operation to pull the trigger 1 from the operational initial position is conducted against the energizing force transmitted to the trigger 1 through the movable bar member 11 from the leaf spring 13 and the trigger 1 is moved to return to the operational initial position by the energizing force exerted by the leaf spring 13 when the operation to pull the trigger 1 is ceased.

The slider 8 has a front portion 8A and a rear portion 8B which is incorporated with the front portion 8A to be positioned at the back of the barrel portion 2 and is attached to be movable to a portion of the body 10 where the barrel portion 2 is provided. When the trigger 1 is put in the operational initial position, the slider 8 is put in a reference position with a front end of the front portion 8A positioned to be close to a front end of the portion of the body 10 where the barrel portion 2 is provided and the rear portion 8B positioned to cover a mid portion of the body 10 including a portion thereof provided between the barrel portion 2 and the grip 6. Further, the slider 8 is forced by a coil spring 15 mounted on the body 10 toward the outside in front of the body 10.

In the rear portion 8B of the slider 8, a cup-shaped member 16 is provided to be fixed to the rear portion 8B and movable with the slider 8. A bottom of the cup-shaped member 16, namely, a rear end portion of the slider 8, constitutes a pressure receiving portion 16A.

Further, in the rear portion 8B of the slider 8, a movable member 17 is also provided. The movable member 17 is positioned to opposite to the pressure receiving portion 16A and to be movable along moving directions of the slider 8. A coil spring (not shown in the drawings) is provided between the movable member 17 and a cylindrical portion 16B of the cup-shaped member 16 for exerting energizing force to the movable member 17 to put the same in tendency of moving toward the pressure receiving portion 16A. When the slider 8 is put in the reference position, the movable member 17 is put in such a reference position as to cause a front portion thereof to be coupled with the tubular member 4A in which the bullet holding chamber 4 is formed and to cause a rear portion thereof to be inserted in the cylindrical portion 16B of the cup-shaped member 16. When the movable member 17 is put in the reference position and the rear portion of the movable member 17 is inserted in the cylindrical portion 16B of the cup-shaped member 16, a sealing ring member 18 mounted on the rear portion of the movable member 17 comes into contact with an inner surface of the cylindrical portion 16B of the cup-shaped member 16 to seal hermetically a space between an outer surface of the rear portion of the movable member 17 and the inner surface of the cylindrical portion 16B of the cup-shaped member 16 and an upper end portion of a magazine 31 contained in the case 9 is closed by the movable member 17.

The hammer 5 has an upper portion with which the cup-shaped member 16 comes selectively into contact and a lower portion which is provided with a plurality of engaging steps and attached to be rotatable with an axis 20 passing through the lower portion of the hammer 5 to a rear end portion of the body 10. One end portion of a hammer strut 23 which has the other end portion connected with a pin 24 to the lower portion of the hammer 5 engages through a cap 22 with a hammer spring 21 provided in a lower portion of the grip 6, and thereby the hammer 5 is forced upward through the hammer strut 23 and the cap 22 by the hammer spring 21 to cause the upper portion thereof to rotate in a direction toward a rear end portion of the slider 8 as indicated by an arrow a in FIG. 1 (a direction). Further, a rotary lever 26 is attached rotatably with an axis 27 to the body 10 to be positioned close to the lower portion of the hammer 5.

In an initial condition wherein the case 9 is inserted into the grip 6 as shown in FIG. 1, the hammer 5 is so positioned that the upper portion of the hammer 5 opposites with a relatively small space to the bottom of the cup-shaped member 16 and the rotary lever 26 is in engagement with the lower portion of the hammer 5. The hammer 5 thus positioned is put in a decocked position.

The rotary lever 26 attached to the body 10 to be rotatable around the axis 27 is provided with a curved shape having an upper end portion thereof engaging with the lower portion of the hammer 5 and a lower portion engaging with a leaf spring 14. The leaf spring 14 is operative to exert energizing force to the rotary lever 26 for causing the upper end portion of the rotary lever 26 to come into contact with the lower portion of the hammer 5. A lower end portion of the leaf spring 14 is attached, together with a lower portion of the leaf spring 13, to a portion of the body 10 positioned in the grip 6.

The axis 27 with which the rotary lever 26 is attached rotatably to the body 10 is also in engagement with a movable contacting member 28. An opening 28A is formed on a mid portion of the movable contacting member 28 and the axis 27 is put in the opening 28A. The movable contacting member 28 is supported by the axis 27 to be rotatable within a range limited by the opening 28A engaging with the axis 27. When the trigger 1 is pulled, a rear end portion of the movable bar member 11 which is moved backward with the trigger 1 comes into contact with the movable contacting member 28 to push the same backward. The movable contacting member 28 thus pushed backward by the movable bar member 11 is operative to move for causing the rotary lever 26 to rotate in the direction against the energizing force exerted by the leaf spring 14 and then to release the hammer 5 put in engagement with the rotary lever 26 from the positional restriction brought about by the engagement with the rotary lever 26. Further, when the trigger 1 is released from the pulling operation and returns to the operational initial position, the rear end portion of the movable bar member 11 which is moved forward with the trigger 1 goes away from the movable contacting member 28. The movable contacting member 28 thus apart from the rear end portion of the movable bar member 11 is operative to cause the rotary lever 26 to rotate in the direction following the energizing force exerted by the leaf spring 14.

The case 9 is inserted into the grip 6 through an opening provided at a lower end portion of the grip 6 and a bottom portion of the case 9 is engaged with the lower end portion of the grip 6 so that the case 9 is held in the grip 6. The case 9 is provided therein with the magazine 31 for containing sham bullets BB, in which a coil spring 30 is provided for pushing up the sham bullets BB, a pressure accumulating chamber 32 which is charged with, for example, liquefied gas for constituting a gas supplying portion, a lower gas passage 33 extending from the pressure accumulating chamber 32, a movable valve 34 provided in relation to the lower gas passage 33, and an upper gas passage 35 connected with the lower gas passage 33. The lower and upper gas passages 33 and 35 constitute the gas leading passage extending from the pressure accumulating chamber 32.

The movable valve 34 is provided to be movable to the lower gas passage 33 for controlling the lower gas passage 33 to be open and closed selectively in dependence on its position. A rod 34A is incorporated with the movable valve 34. The movable valve 34 thus constituted is normally positioned to make the lower gas passage 33 closed with energizing force exerted by a coil spring 36 mounted on the rod 34A, as shown in FIG. 1. The lower and upper gas passages 33 and 35 are formed in a portion above the pressure accumulating chamber 32 of the case 9 which is placed in the grip 6 and therefore the movable valve 34 provided to be movable to the lower gas passage 33 is also provided in the portion above the pressure accumulating chamber 32 of the case 9 held in the grip 6.

In the body 10 in which the case 9 is held in the grip 6, a movable shooting pin 39 is positioned at the back of the movable valve 34. A coil spring 40 is mounted on the movable shooting pin 39. The movable shooting pin 39 thus provided is so forced by the coil spring 40 as to be normally put in a reference position apart a little from a rear end portion of the rod 34A incorporated with the movable valve 34, as shown in FIG. 1. In a situation wherein the movable shooting pin 39 is put in the reference position and the hammer 5 is put in the decocked position, there is an extremely small space between a rear end portion of the movable shooting pin 39 and the upper portion of the hammer 5. When the movable shooting pin 39 is moved against energizing force exerted by the coil spring 40, a front end portion of the movable shooting pin 39 strikes on the rear end portion of the rod 34A to move the movable valve 34 against the energizing force exerted by the coil spring 36 and the movable valve 34 thus moved is operative to shift the lower gas passage 33 to be open.

A portion of the first embodiment shown in FIG. 1 containing the hammer 5, the rotary lever 26, the movable valve 34, the gas leading passage constituted with the lower and upper gas passages 33 and 35 and the movable shooting pin 39 constitutes a gas supplying mechanism by which the gas from the pressure accumulating chamber 32 is supplied into the movable member 17 when the trigger 1 is pulled.

Figure 2:
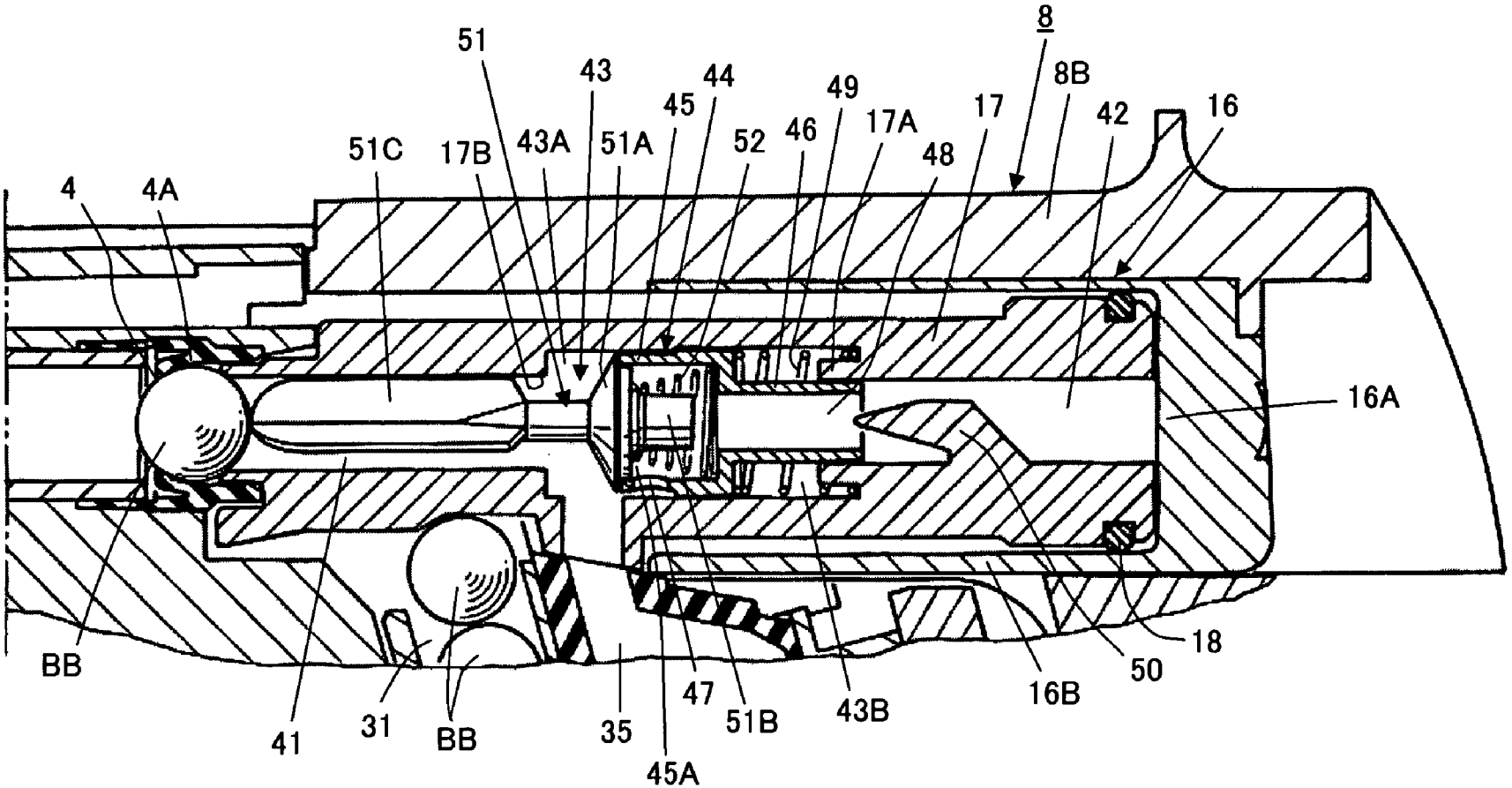
FIGS. 2 to 13 are partial cross sectional views used for explanation of the structure and operation of the first embodiment shown in FIG. 1.

The movable member 17 is provided therein an inner space which forms a first gas passage 41, a second gas passage 42 and a connecting gas passage 43 for connecting the first and second gas passages 41 and 42 with each other, as shown in FIG. 2. The first gas passage 41 extends from the connecting gas passage 43 to the bullet holding chamber 4 and the second gas passage 42 extends from the connecting gas passage 43 to the pressure receiving portion 16A. The connecting gas passage 43 has a portion 43A which is coupled with the upper gas passage 35 constituting the gas leading passage when the movable member 17 is put in the reference position and a portion 43B which extends from the portion 43A to the second gas passage 42.

With the portion 43A of the connecting gas passage 43 thus provided, the inner space formed in the movable member 17 is coupled with the gas leading passage and removed from the gas leading passage selectively. Then, a gas flow limiting member 44 is provided to be movable in the portion 43B of the connecting gas passage 43.

The gas flow limiting member 44 has a bottomless cup-shaped portion 45 provided with a center opening instead of a bottom and a relatively small opening 47 on its side wall and a cylindrical portion 46 extending from the bottomless cup-shaped portion 45 toward the second gas passage 42. A third gas passage 48 extending from the center opening formed on the bottomless cup-shaped portion 45 into the second gas passage 42 is formed in the cylindrical portion 46. Further, a coil spring 49 is mounted on the cylindrical portion 46 for exerting energizing force to the gas flow limiting member 44 in its entirety to put the same in tendency of going away from the pressure receiving portion 16A.

The gas flow limiting member 44 is provided to be movable between a reference position where a rear end portion of the third gas passage 48 is inserted into the second gas passage 42, as shown in FIGS. 1 and 2, and a position where the bottomless cup-shaped portion 45 comes into contact with a circular contacting portion 17A provided on the movable member 17. Then, the gas flow limiting member 44 is normally put in the reference position with the energizing force exerted by the coil spring 49.

A fixed member 50 is incorporated with the movable member 17 to be provided in the same. The fixed member 50 has a gas flow limiting member 44 and is opposite to the gas flow limiting member 44 in such a manner that a top end of the cone-shaped portion is inserted in the third gas passage 48 formed in the cylindrical portion 46 of the gas flow limiting member 44. A cylindrical gas passage through which gas led through the third gas passage 48 and the second gas passage 42 to the pressure receiving portion 16A flows is formed around the cone-shaped portion of the fixed member 50. The area of opening of the cylindrical gas passage formed around the cone-shaped portion of the fixed member 50 is limited by a rear end of the cylindrical portion 46 of the gas flow limiting member 44.

When the gas flow limiting member 44 is put in the reference position, as shown in FIGS. 1 and 2, the top end of the cone-shaped portion of the fixed member 50 is inserted just slightly in the third gas passage 48 formed in the cylindrical portion 46 of the gas flow limiting member 44. Under such a condition, the cylindrical gas passage formed around the cone-shaped portion of the fixed member 50 has a relatively large area of opening. When the gas flow limiting member 44 is moved against the energizing force exerted by the coil spring 49 from the reference position toward the pressure receiving portion 16A, the top end of the cone-shaped portion of the fixed member 50 is inserted deeply little by little in the third gas passage 48 formed in the cylindrical portion 46 of the gas flow limiting member 44. As a result, the area of opening of the cylindrical gas passage formed around the cone-shaped portion of the fixed member 50 is limited to be gradually reduced by the rear end of the cylindrical portion 46 of the gas flow limiting member 44.

The reduction in the area of opening of the cylindrical gas passage formed around the cone-shaped portion of the fixed member 50 brings about reduction in the amount of gas flowing through the third gas passage 48 and the second gas passage 42 to the pressure receiving portion 16A. Accordingly, the gas flow limiting member 44 and the fixed member 50 constitute a gas flow adjusting mechanism for adjusting the amount of gas flowing through the third gas passage 48 and the second gas passage 42 to the pressure receiving portion 16A.

Further, a gas passage controller 51 is also provided to be movable in the inner space formed in the movable member 17. The gas passage controller 51 is constituted with a valve 51A provided in the connecting gas passage 43, a rod 51B extending from the valve 51A toward the third gas passage 48 and a flow straightener 51C extending from the valve 51A through the first gas passage 41 toward the bullet holding chamber 4. The gas passage controller thus constituted is put in tendency of moving toward the bullet holding chamber 4 with energizing force exerted by a coil spring 52 which is mounted on the rod 51B with one end thereof engaging with a rear end of the bottomless cup-shaped portion 45 of the gas flow limiting member 44. The valve 51A of the gas passage controller 51 is of such a size as to be able to close each of an opening 17B provided on a portion of the movable member 17 forming the first gas passage 41 to face to the connecting gas passage 43 and an opening 45A provided on the bottomless cup-shaped portion 45 to be put in the connecting gas passage 43. When the valve 51A of the gas passage controller 51 is operative to close the opening 17B, the first gas passage 41 is closed. Accordingly, the gas passage controller 51 is operative to control the first gas passage 41 to be open and closed selectively.

The opening 47 formed on the bottomless cup-shaped portion 45 of the gas flow limiting member 44 is operative to connect the third gas passage 48 through the bottomless cup-shaped portion 45 with the connecting gas passage 43 even if the opening 45A provided on the bottomless cup-shaped portion 45 is closed by the valve 51A of the gas passage controller 51. Accordingly, the third gas passage 48 is still open when the opening 45A provided on the bottomless cup-shaped portion 45 is closed by the valve 51A of the gas passage controller 51.

In the first embodiment constituted as described above and shown in FIGS. 1 and 2, under a condition wherein the case 9 has been held in the grip 6 and the sham bullet BB has not been supplied yet to the bullet holding chamber 4, an initial operation in which the slider 8 is once moved backward, together with the movable member 17, manually from the reference position and then released to be move forward with energizing force exerted by the coil spring 15 so as to return, together with the movable member 17, to the reference position, is performed.

During the backward movement of the slider 8 from the reference position, the movable member 17 which has made the upper end portion of the magazine 31 closed is moved backward together with the slider 8, so that the upper end portion of the magazine 31 is made open and one of the sham bullets BB at the top in the magazine 31 is pushed up by the coil spring 30 into the upper end portion of the magazine 31 to be held therein.

Figure 3:
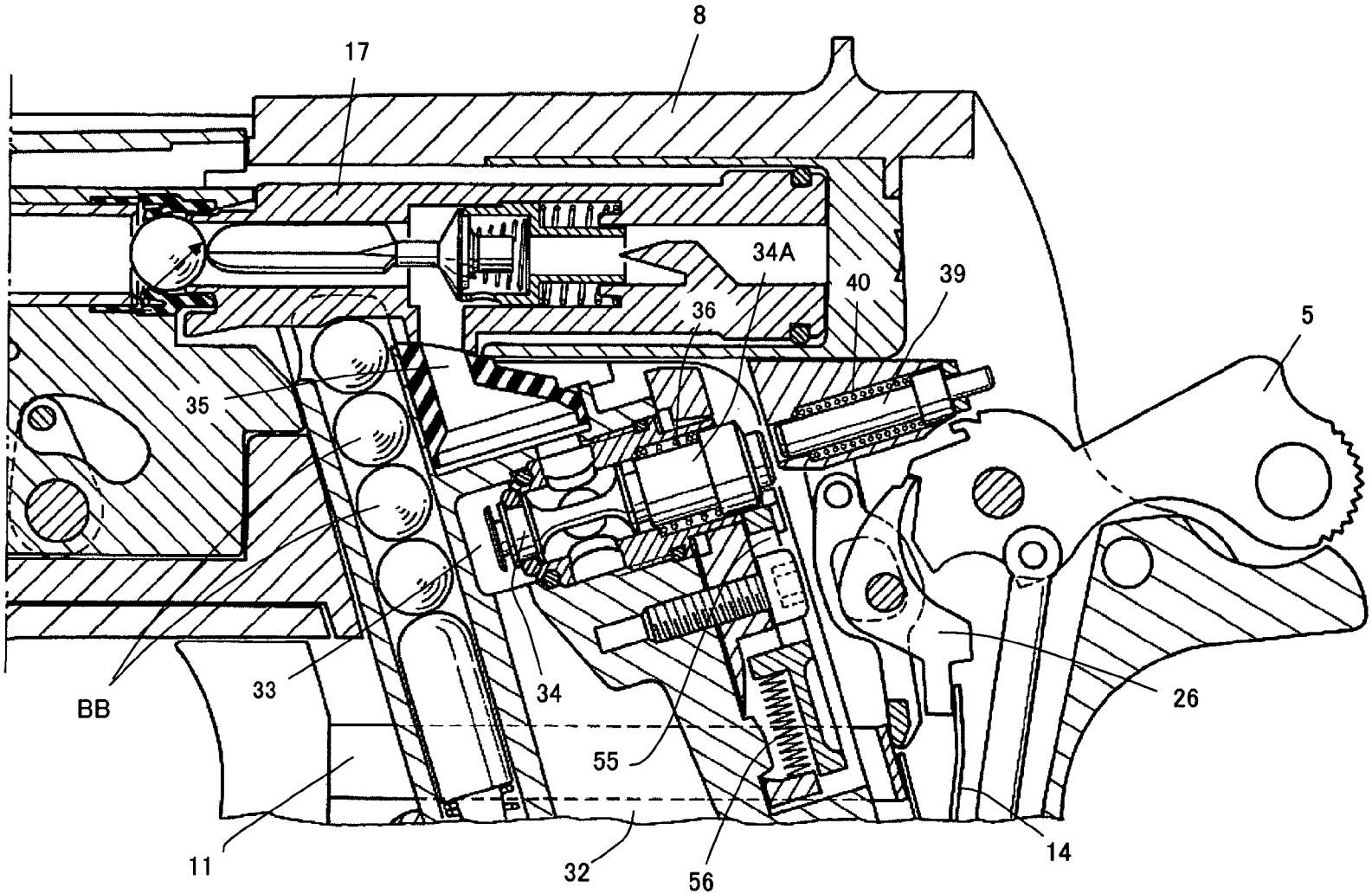

Further, the hammer 5 which has been put in the decocked position is pushed by the slider 8 moving backward to be released from the engagement with the rotary lever 26 and to rotate against the energizing force exerted by the hammer spring 21 from the decocked position in a direction indicated by an arrow b in FIG. 1 (b direction) and opposite to the a direction, and thereby, the rotary lever 26 is rotated in the direction following the energizing force exerted by the leaf spring 14. The hammer 5 having rotated in the b direction reaches a cocked position where there is a relatively large space between the upper portion of the hammer 5 and the rear end portion of the movable shooting pin 39 put in the reference position, as shown in FIG. 3 and the upper end portion of the rotary lever 26 engages with the lower portion of the hammer 5, so that the hammer 5 and the rotary lever 26 are mutually fixed in position and the hammer 5 is kept in the cocked position.

Then, when the slider 8 moves forward toward the reference position after having moved backward once, the movable member 17 is also moved forward together with the slider 8 moving forward so as to cause the front portion thereof to come into the upper end portion of the magazine 31 and to carry the sham bullet BB in the upper end portion of the magazine 31 to the bullet holding chamber 4. On that occasion, the movable member 17 is operative again to close the upper end portion of the magazine 31 and to cause the front portion thereof to be coupled with the tubular member 4A constituting the bullet holding chamber 4 so that the movable member 17 is fixed in position at the reference position. As a result, the sham bullet BB is supplied to the bullet holding chamber 4 to be put in the same and a front end portion of the flow straightener 51C of the gas passage controller 51 comes into contact with the sham bullet BB put in the bullet holding chamber 4, as shown in FIGS. 1 and 2.

When the slider 8 has returned to the reference position after its forward movement and the movable member 17 has also returned to the reference position together with the slider 8, the portion 43A of the connecting gas passage 43 formed in the movable member 17 is again coupled with the upper gas passage 35 constituting the gas leading passage. Further, the gas passage controller 51 in the movable member 17 is pushed backward by means of the flow straightener 51C coming into contact with the sham bullet BB put in the bullet holding chamber 4 and thereby the valve 51A goes away from the opening 17B to make the first gas passage 41 open and is put in a rear position to close the opening 45A.

Figure 4:
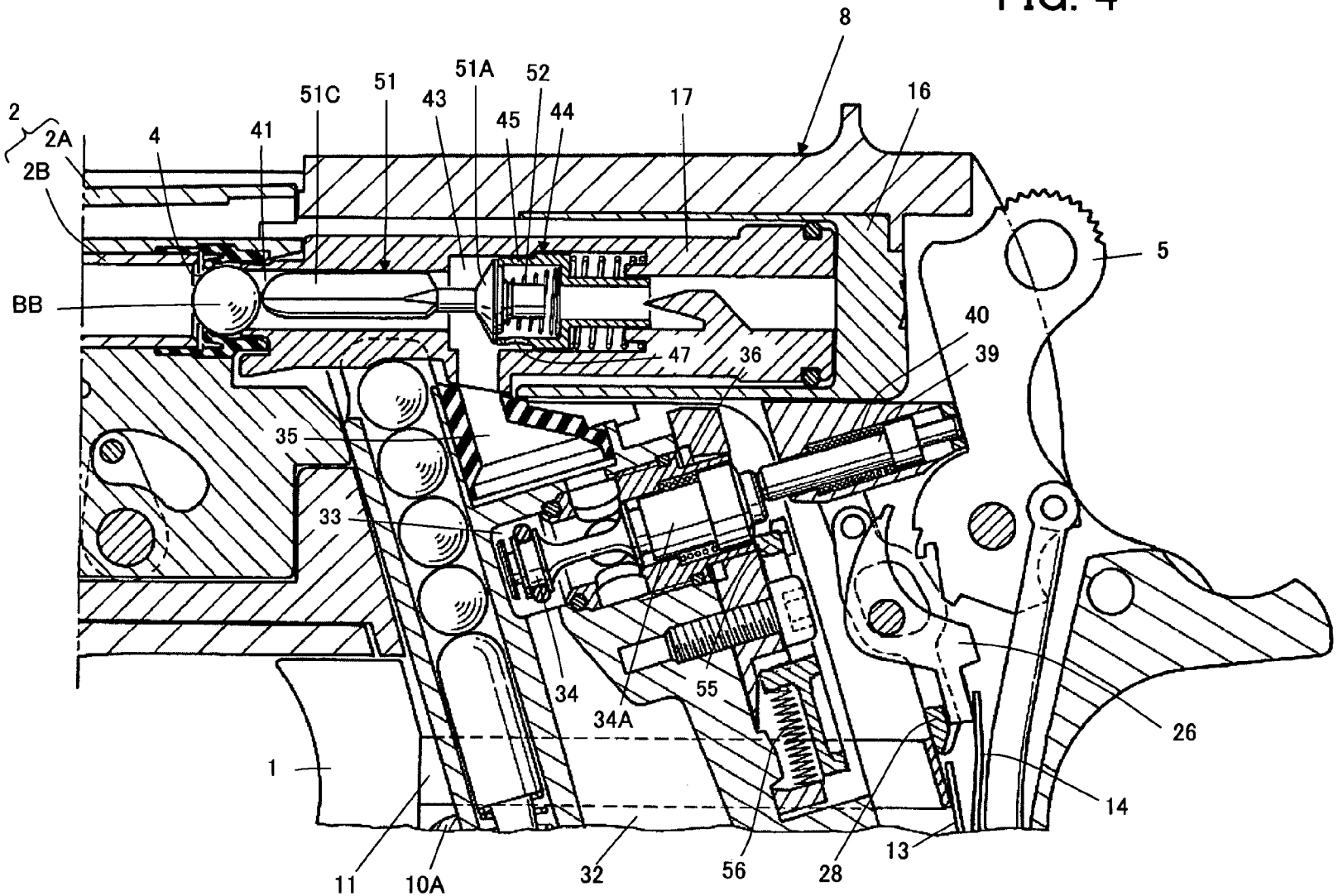

After the sham bullet BB has been supplied to the bullet holding chamber 4 as described above and shown in FIGS. 1 and 2, when the trigger 1 is pulled, the movable bar member 11 is moved backward against the energizing force exerted by the leaf spring 13. With the backward movement of the movable bar member 11, the movable contacting member 28 causes the rotary lever 26 to rotate against the energizing force exerted by the leaf spring 14. Consequently, the hammer 5 having been put in the cocked position is released from the positional restriction by the rotary lever 26 and rotated in the a direction with the energizing force exerted by the hammer spring 21 to strike forcibly the movable shooting pin 39 with the upper portion thereof coming close to the cup-shaped member 16, as shown in FIG. 4. Thereby, the movable shooting pin 39 is moved against the energizing force exerted by the coil spring 40 from the reference position for causing the movable valve 34 to move from the position for making the lower gas passage 33 closed to the position for making the lower gas passage 33 open. With the movement of the movable valve 34 to the position for making the lower gas passage 33 open, a locking member 55 provided below the rod 34A incorporated with the movable valve 34 is moved upward with energizing force exerted by a coil spring 56 to engage with the rear end portion of the rod 34A for putting the movable valve 34 in positional restriction at the position for making the lower gas passage 33 open.

Immediately after the lower gas passage 33 is made open by the movable valve 34, gas discharged from the pressure accumulating chamber 32 is supplied through the gas leading passage constituted with the lower and upper gas passages 33 and 35 to the inner space formed in the movable member 17. In the inner space formed in the movable member 17, the gas is led through the connecting gas passage 43 and the first gas passage 41 made open by the valve 51A of the gas passage controller 51 to the bullet holding chamber 4. The gas flowing through the first gas passage 41 is straightened by the flow straightener 51C of the gas passage controller 51.

The gas led to the bullet holding chamber 4 exerts pressure of gas to the sham bullet BB put in the bullet holding chamber 4. Thereby, the sham bullet BB put in the bullet holding chamber 4 is caused by the pressure of gas exerted thereto to move from the bullet holding chamber 4 into the barrel portion 2 so as to be shot from the bullet holding chamber 4.

Under such a condition, the gas discharged from the pressure accumulating chamber 32 is also supplied through the opening 47 formed on the side wall of the bottomless cup-shaped portion 45 of the gas flow limiting member 44 in the bottomless cup-shaped portion 45. The gas supplied in the bottomless cup-shaped portion 45 exerts relatively small pressure of gas to the valve 51A of the gas passage controller 51 for putting the same in tendency of moving forward.

Further, in the movable member 17, a front surface of the valve 51A of the gas passage controller 51 is pushed backward with the pressure of the gas flowing through the connecting gas passage 43 into the first gas passage 41. Therefore, the gas passage controller 51 stays at the rear position for a little while without being moved forward with the energizing force exerted by the coil spring 52 immediately after the sham bullet BB is shot from the bullet holding chamber 4 and thereby the front end portion of the flow straightener 51C of the gas passage controller 51 is not in contact with the sham bullet BB.

The sham bullet BB shot from the bullet holding chamber 4 moves forward at a high speed in the barrel portion 2 and discharges from the muzzle provided on the barrel portion 2. With such movements of the sham bullet BB, the pressure of gas in the first gas passage 41 and the connecting gas passage 43 in the movable member 17 is reduced. As a result, the pressure of gas acting on the front surface of the valve 51A of the gas passage controller 51 put in the rear position is reduced and the gas passage controller 51 is moved forward with the energizing force exerted by the coil spring 52 and the pressure of the gas supplied in the bottomless cup-shaped portion 45 of the gas flow limiting member 44. The gas passage controller 51 moving forward reaches to a front position where the valve 51A apart from the bottomless cup-shaped portion 45 of the gas flow limiting member 44 is operative to close the opening 17B provided on the movable member 17 so that the first gas passage 41 is shifted to be closed, as shown in FIG. 5.

With the gas passage controller 51 thus put in the front position, the gas discharged from the pressure accumulating chamber 32 is supplied through the gas leading passage constituted with the lower gas passage 33 made open by the movable valve 34 and the upper gas passage 35 and the connecting gas passage 43 formed in the movable member 17 to the third gas passage 48 formed in the cylindrical portion 46 of the gas flow limiting member 44. Under such a situation, with the gas acting directly on the bottomless cup-shaped portion 45 of the gas flow limiting member 44, pressure of gas against the energizing force exerted by the coil spring 49 acts on the gas flow limiting member 44.

The pressure of gas against the energizing force exerted by the coil spring 49 thus acting on the gas flow limiting member 44 varies in its value in response to variations in atmospheric temperature around the first embodiment shown in FIGS. 1 and 2. For example, when the atmospheric temperature is less than 20° C., the pressure of gas against the energizing force exerted by the coil spring 49 acting on the gas flow limiting member 44 has a value less than a predetermined value, and when the atmospheric temperature is equal to or more than 20° C., the pressure of gas against the energizing force exerted by the coil spring 49 acting on the gas flow limiting member 44 has a value equal to or more than the predetermined value and the higher the atmospheric temperature is, the larger the pressure of gas against the energizing force exerted by the coil spring 49 acting on the gas flow limiting member 44 is.

Figure 5:
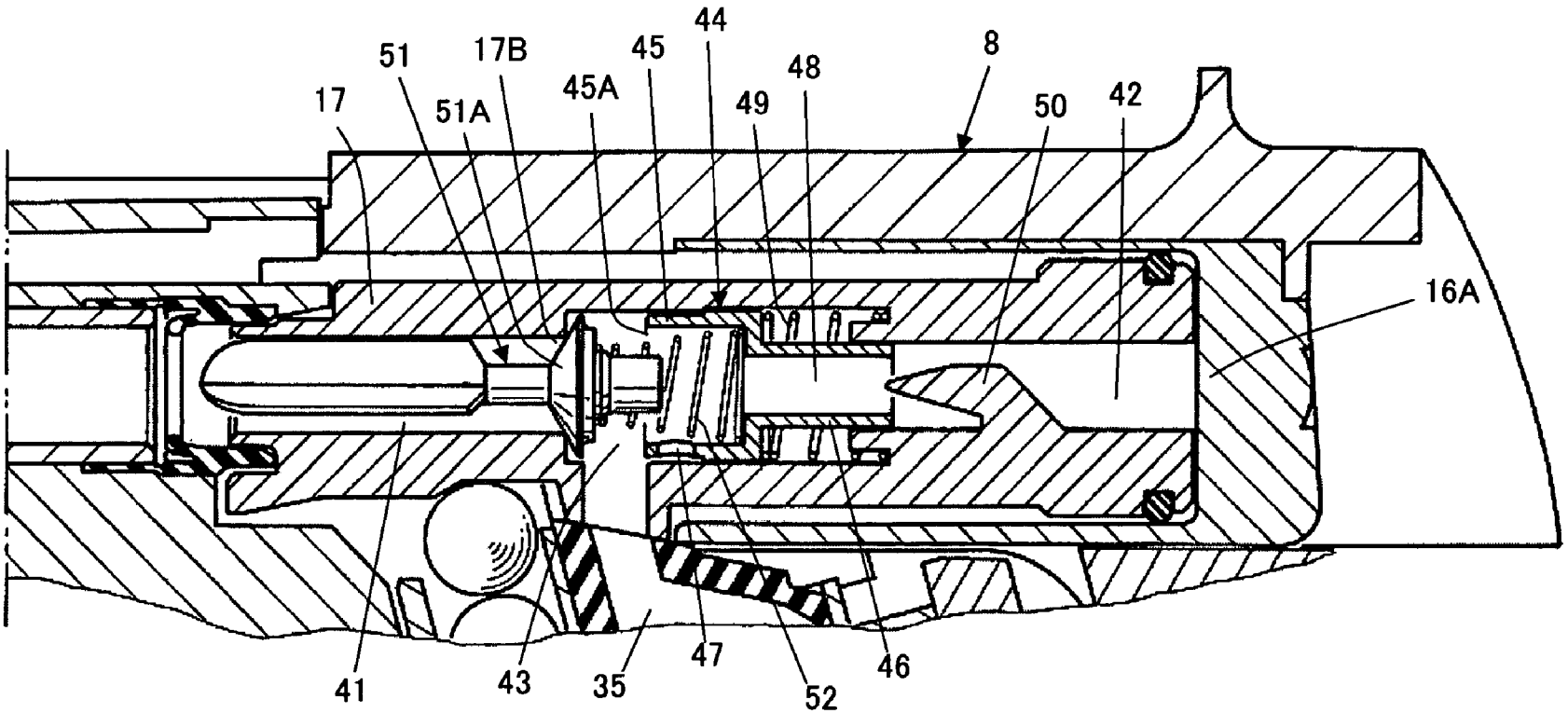

When the pressure of gas against the energizing force exerted by the coil spring 49 acting on the gas flow limiting member 44 has the value less than the predetermined value, the coil spring 49 is put in an elongated state for keeping the gas flow limiting member 44 in the reference position, so that the top end of the cone-shaped portion of the fixed member 50 is inserted just slightly in the third gas passage 48 formed in the cylindrical portion 46 of the gas flow limiting member 44 and the cylindrical gas passage formed around the cone-shaped portion of the fixed member 50 has the relatively large area of opening, as shown in FIG. 5. As a result, the amount of gas flowing through the third gas passage 48 and the second gas passage 42 including the cylindrical gas passage formed around the cone-shaped portion of the fixed member 50 to the pressure receiving portion 16A is relatively large.

Figure 6:
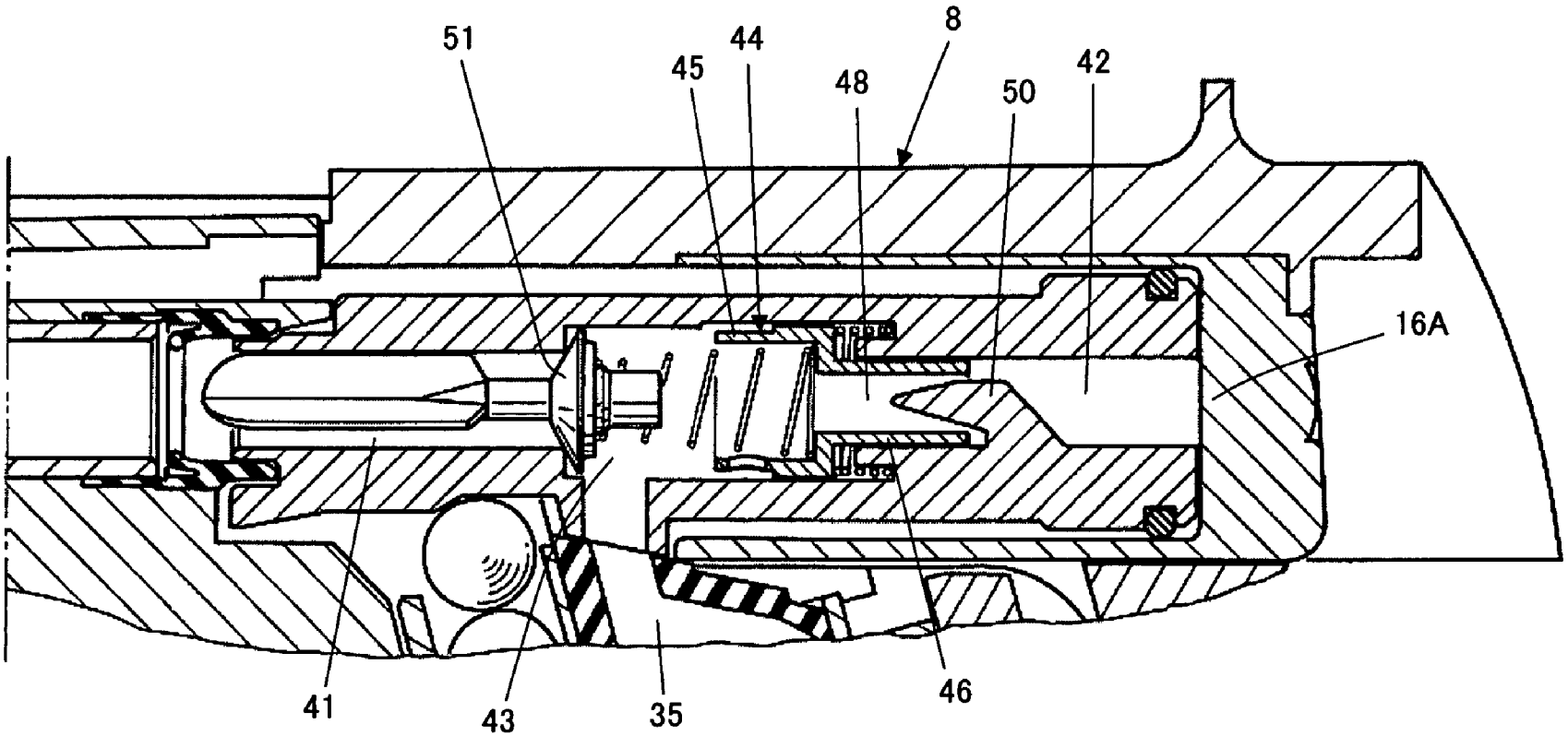

On the other hand, when the pressure of gas against the energizing force exerted by the coil spring 49 acting on the gas flow limiting member 44 has the value equal to or more than the predetermined value, the larger the pressure of gas acting on the gas flow limiting member 44 is, the larger scale the coil spring 49 is compressed on, so that the movement of the gas flow limiting member 44 from the reference position toward the pressure receiving portion 16A is increased. Consequently, with the increase of the pressure of gas acting on the gas flow limiting member 44, the top end of the cone-shaped portion of the fixed member 50 is inserted deeply little by little in the third gas passage 48 formed in the cylindrical portion 46 of the gas flow limiting member 44 and the area of opening of the cylindrical gas passage formed around the cone-shaped portion of the fixed member 50 is limited to be gradually reduced, as shown in FIG. 6. As a result, with the increase of the pressure of gas acting on the gas flow limiting member 44, the amount of gas flowing through the third gas passage 48 and the second gas passage 42 including the cylindrical gas passage formed around the cone-shaped portion of the fixed member 50 to the pressure receiving portion 16A is gradually reduced.

Figure 7:
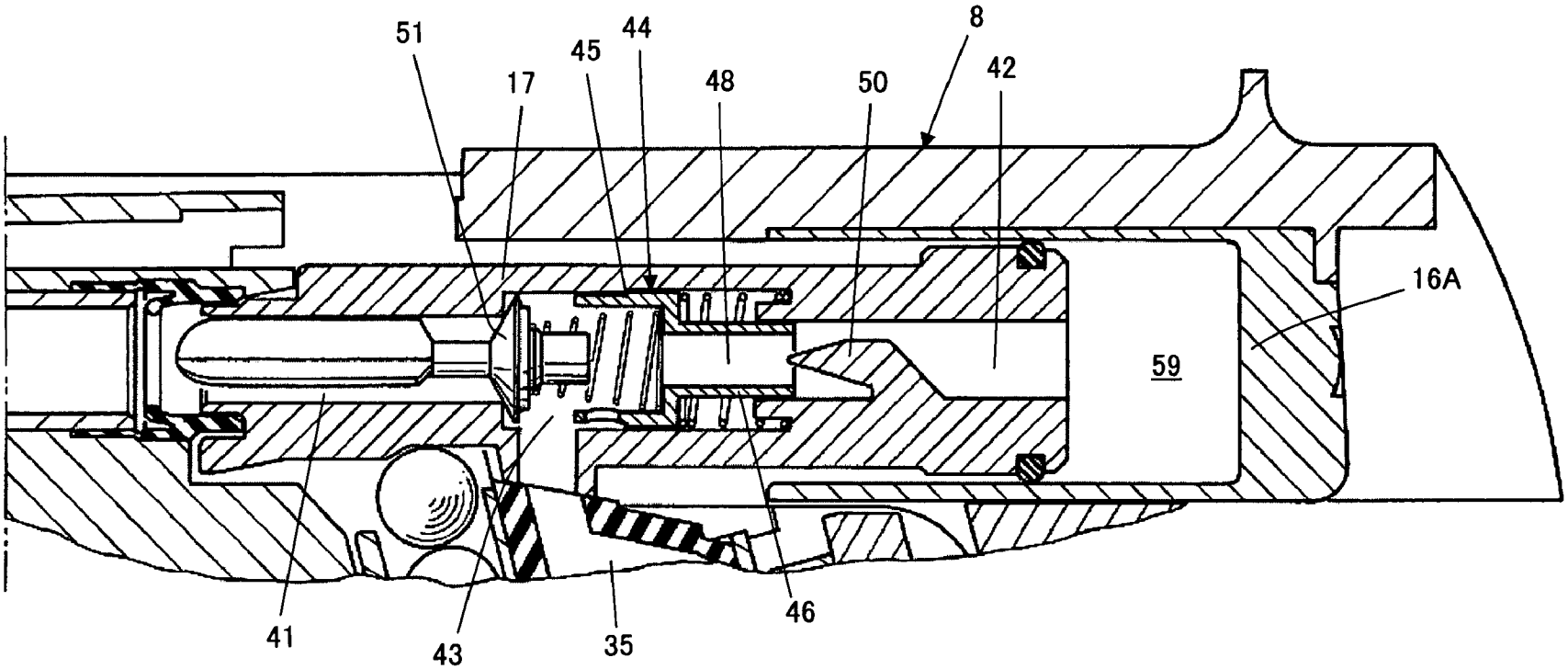

When the gas flow limiting member 44 is put in the reference position, as shown in FIG. 5, and the amount of gas flowing through the third gas passage 48 and the second gas passage 42 including the cylindrical gas passage formed around the cone-shaped portion of the fixed member 50 to the pressure receiving portion 16A is relatively large, the pressure of gas acting on the pressure receiving portion 16A is suddenly increased with the gas of the relatively large amount having the pressure value less than the predetermined value. Consequently, the pressure receiving portion 16A is rapidly moved backward with the pressure of gas suddenly increased so that a pressure chamber 59 having variable capacity formed between a rear end of the movable member 17 and the pressure receiving portion 16A in the cup-shaped member 16 is rapidly enlarged, as shown in FIG. 7. With this rapid backward movement of the pressure receiving portion 16A, the slider 8 having been put in the reference position is rapidly moved backward against the energizing force exerted by the coil spring 15.

Figure 8:
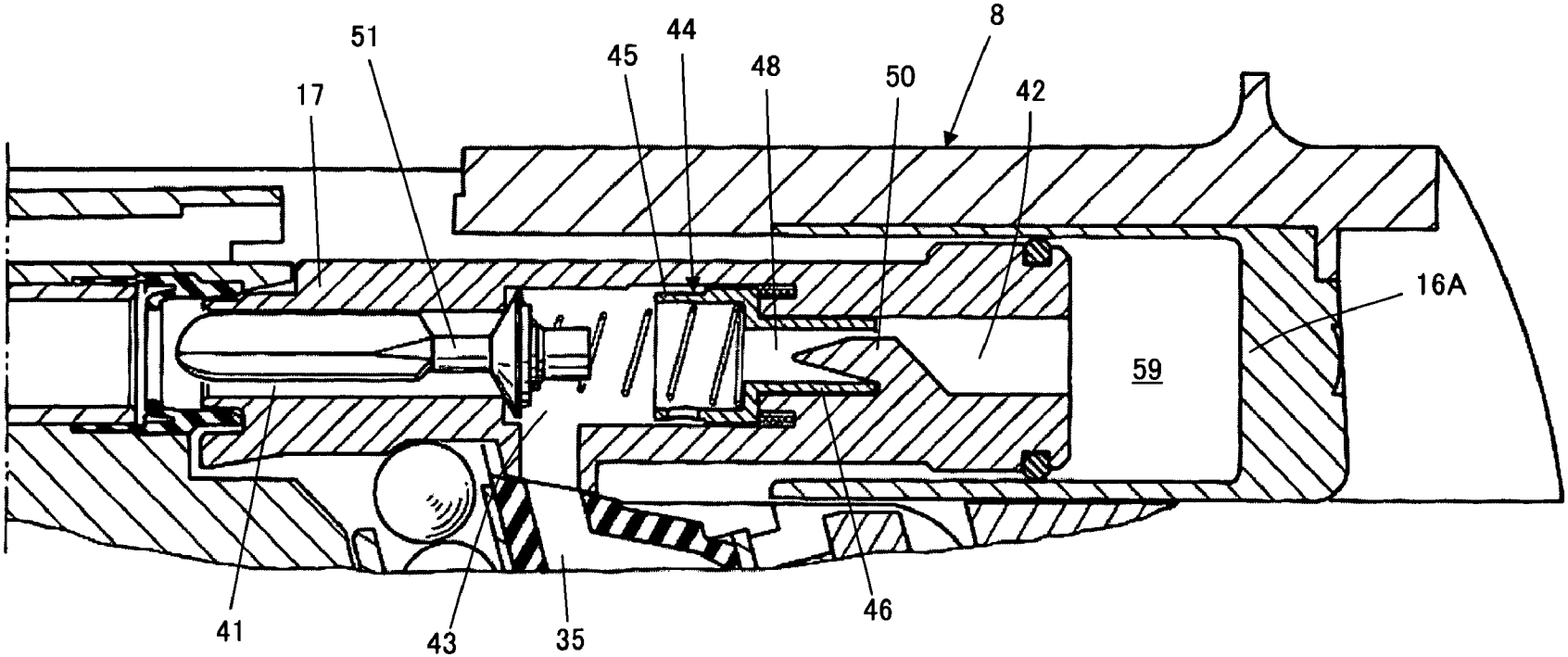

When the gas flow limiting member 44 is moved backward from the reference position to such a position as shown in FIG. 6 and the amount of gas flowing through the third gas passage 48 and the second gas passage 42 including the cylindrical gas passage formed around the cone-shaped portion of the fixed member 50 to the pressure receiving portion 16A is gradually reduced with the increase of the pressure of gas acting on the gas flow limiting member 44, the pressure of gas acting on the pressure receiving portion 16A is suddenly increased with the gas of the reduced amount having the pressure value equal to or more than the predetermined value. Consequently, the pressure receiving portion 16A is rapidly moved backward with the pressure of gas suddenly increased so that a pressure chamber 59 having variable capacity formed between a rear end of the movable member 17 and the pressure receiving portion 16A in the cup-shaped member 16 is rapidly enlarged, as shown in FIG. 8. With this rapid backward movement of the pressure receiving portion 16A, the slider 8 having been put in the reference position is rapidly moved backward against the energizing force exerted by the coil spring 15.

Figure 9:
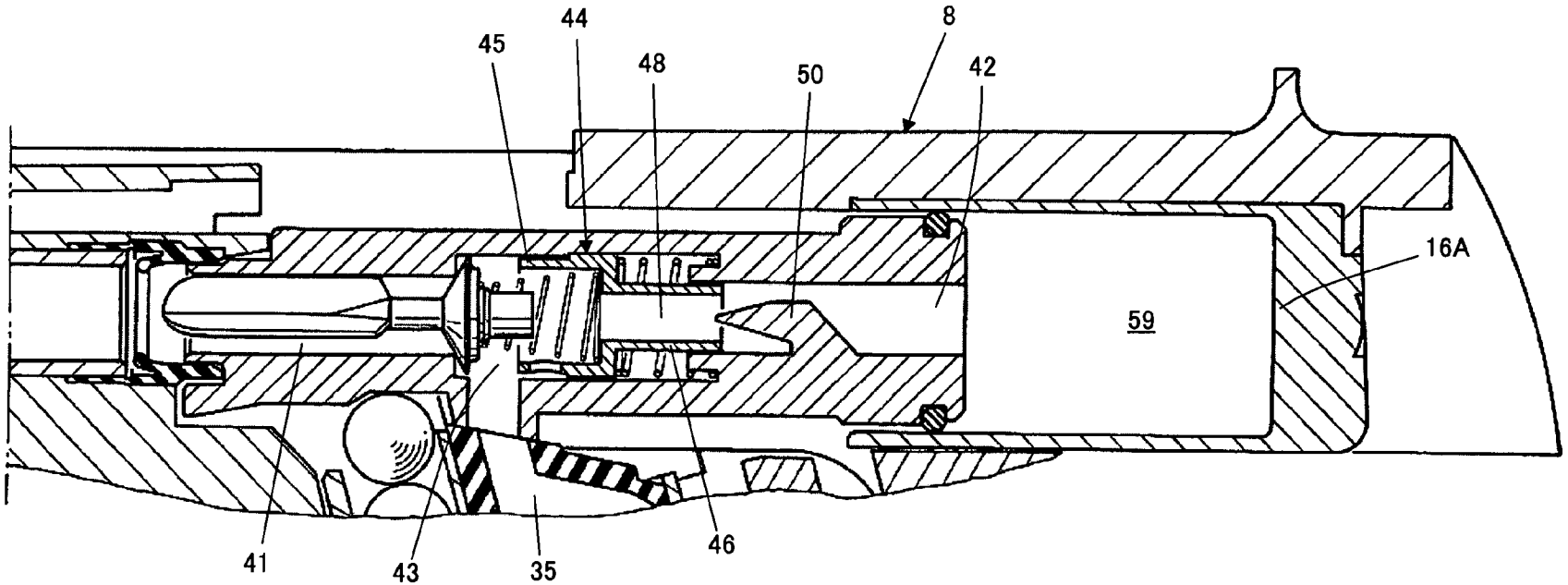

As described above, when the pressure of gas acting on the gas flow limiting member 44 has the value less than the predetermined value, the gas with which the pressure of gas having the relatively small value is applied to the gas flow limiting member 44 flows with the relatively large amount through the second gas passage 42 including the cylindrical gas passage formed around the cone-shaped portion of the fixed member 50 to the pressure receiving portion 16A so that sufficient pressure of gas acts on the pressure receiving portion 16A. Consequently, the slider 8 is moved backward with the pressure of gas acting on the pressure receiving portion 16A at an appropriate speed with which the pressure chamber 59 having variable capacity is rapidly and surely enlarged, as shown in FIG. 9.

Figure 10:
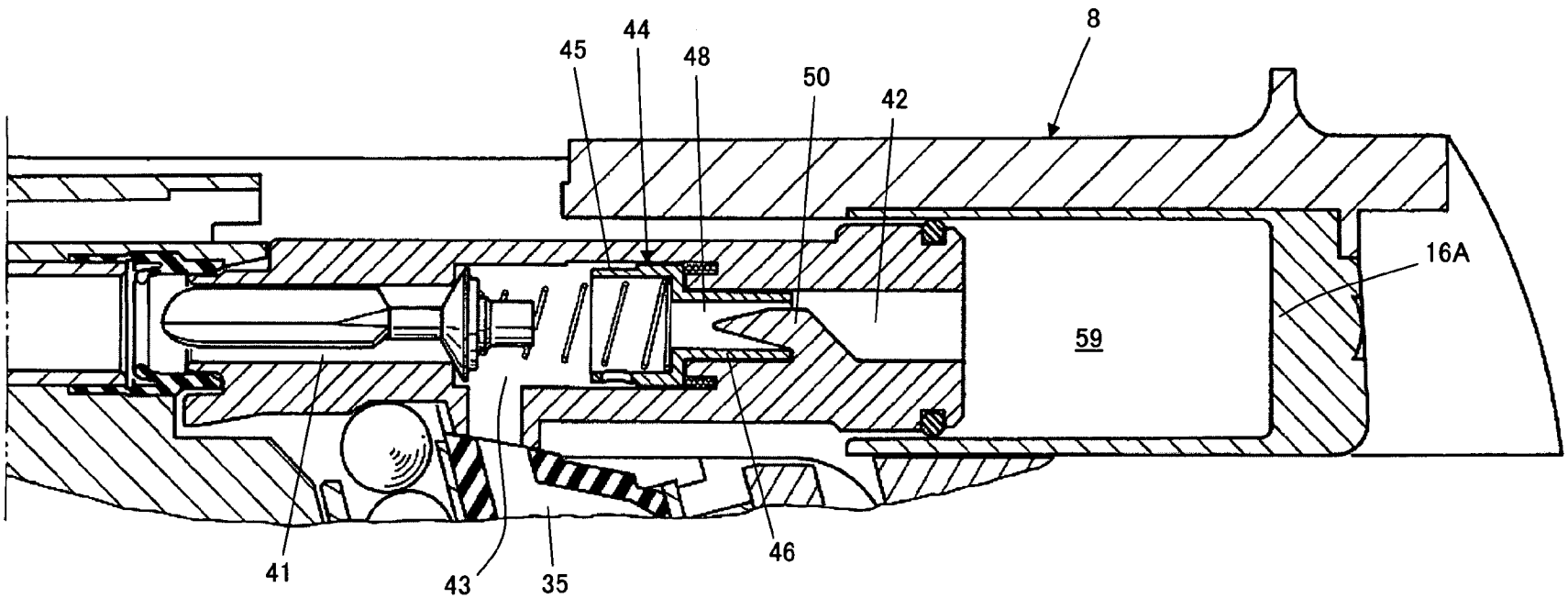

Further, when the pressure of gas acting on the gas flow limiting member 44 has the value equal to or more than the predetermined value, the gas with which the pressure of gas having the relatively large value is applied to the gas flow limiting member 44 flows with the amount reduced enough through the second gas passage 42 including the cylindrical gas passage formed around the cone-shaped portion of the fixed member 50 to the pressure receiving portion 16A so that sufficient pressure of gas acts on the pressure receiving portion 16A. Consequently, the slider 8 is moved backward with the pressure of gas acting on the pressure receiving portion 16A at an appropriate speed with which the pressure chamber 59 having variable capacity is rapidly and surely enlarged, without moving back at an excessive high speed, as shown in FIG. 10.

With the backward movement of the slider 8 from the reference position performed as described above, the hammer 5 having the upper portion thereof being in contact with the cup-shaped member 16 is rotated in the b direction against the energizing force exerted by the hammer spring 21. Thereby, the movable shooting pin 39 is released from the pushing engagement with the hammer 5 to return to the reference position with the energizing force exerted by the coil spring 40, as shown in FIG. 3. Then, immediately after the movable shooting pin 39 has returned to the reference position, the locking member 55 by which the movable valve 34 is put in the positional restriction is pushed downward against the energizing force exerted by the coil spring 56 by means of a predetermined member (not shown in the drawings) engaging with slider 8 to be released from the engagement with the rear portion of the rod 34A incorporated with the movable valve 34. As a result, the movable valve 34 is moved backward with the energizing force exerted by the coil spring 36 to return to the position for shifting the lower gas passage 33 to be closed, as shown in FIG. 3.

Figure 11:
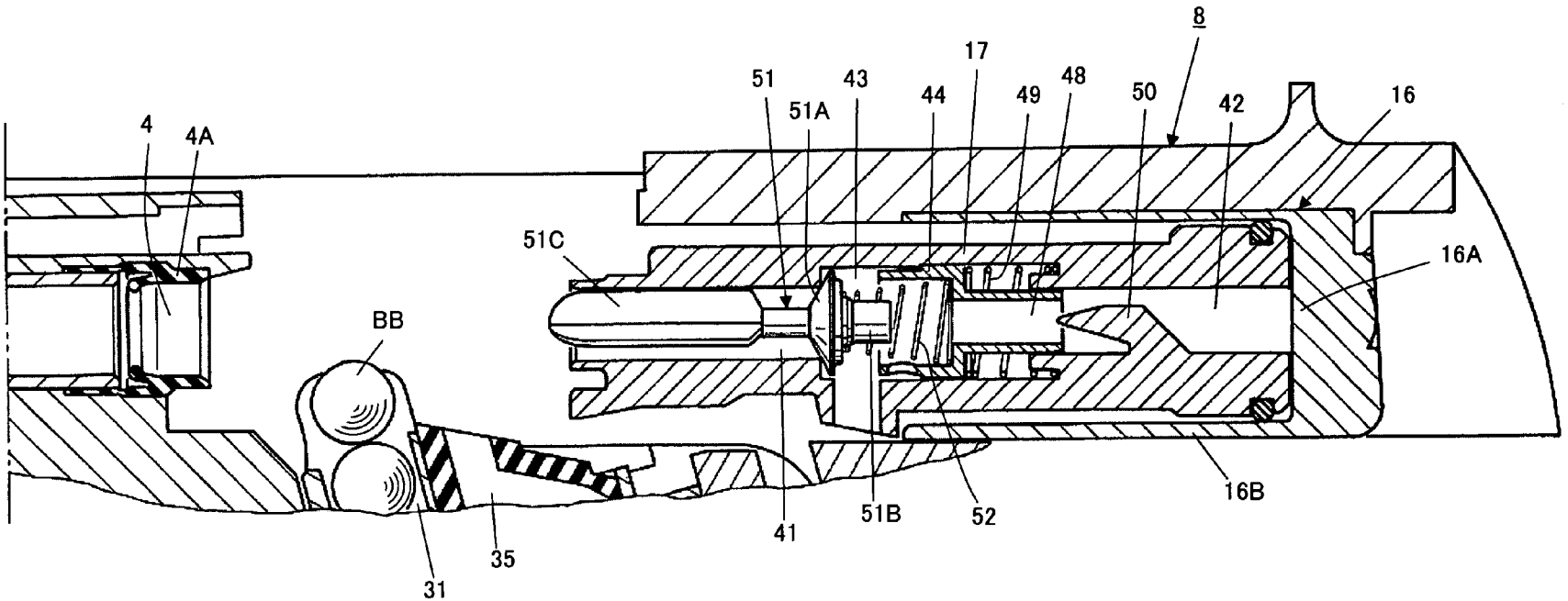

Although the supply of the gas discharged from the pressure accumulating chamber 32 to the second gas passage 42 is ceased when the lower gas passage 33 is shifted to be closed, the slider 8 moving backward at the appropriate speed continues to move backward further with inertia just after the lower gas passage 33 is shifted, so as to reach to the most retreated position surely without bringing about excessive mechanical shock, as shown in FIG. 11.

Figure 12:
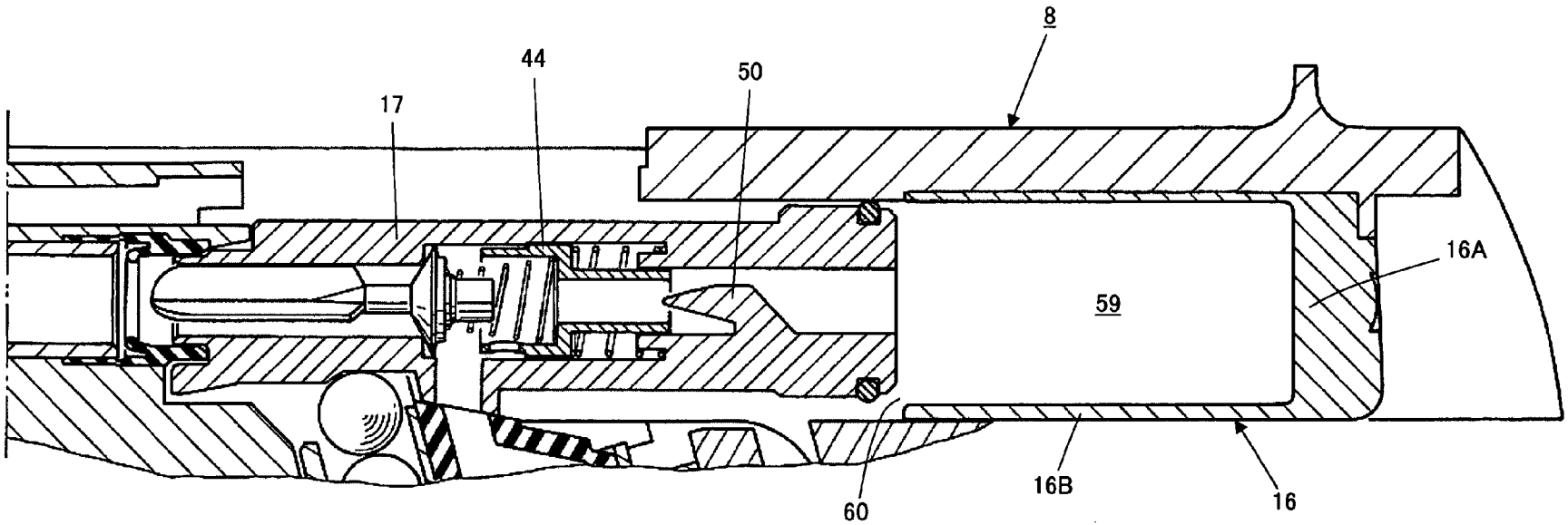
Figure 13:
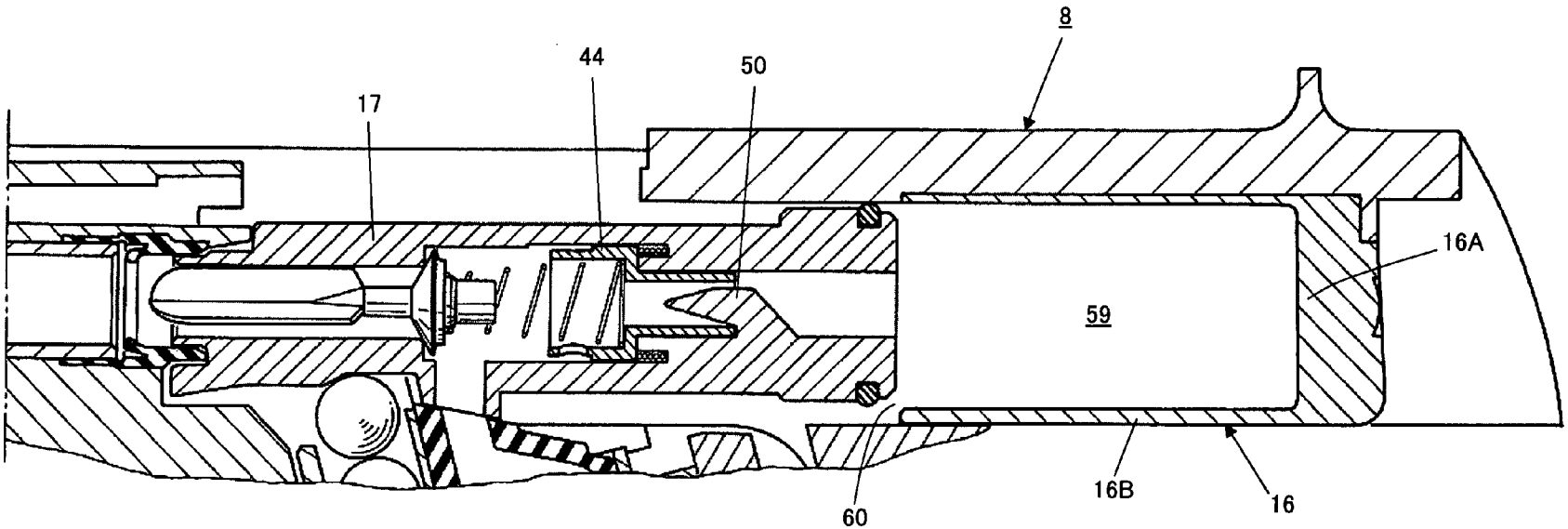

When the slider 8 reaches to the most retreated position, the rear portion of the movable member 17 is out of the cylindrical portion 16B of the cup-shaped member 16 so that a space 60 is formed between the movable member 17 and the cup-shaped member 16, as shown in FIGS. 12 and 13, in each of the case where the gas flow limiting member is put in the reference position and the case where the gas flow limiting member is put in the position apart from the reference position toward the pressure receiving portion 16A. Thereby, an opening provided on the cylindrical portion 16B of the cup-shaped member 16 is open to the atmosphere and the pressure of gas in the pressure chamber 59 having variable capacity is suddenly reduced to the atmospheric pressure. Consequently, the movable member 17 is rapidly moved backward to the cup-shaped member 16 with the energizing force exerted by the coil spring, which is not shown in the drawings, and the rear portion of the movable member 17 is again inserted in the cylindrical portion 16B of the cup-shaped member 16, as shown in FIG. 11. Under this situation, the gas flow limiting member 44 is put in the position balanced with the energizing force exerted by the coil spring 49, namely, the reference position.

With the movable member 17 thus moved backward, the upper end portion of the magazine 31 which has been closed by the mid portion of the movable member 17 is shifted to be open and one of the sham bullets BB at the top in the magazine 31 is pushed up into the upper end portion of the magazine 31 to be held therein.

Just after the slider 8 has reached to the most retreated position, the slider 8 is moved forward, together with the movable member 17, with the energizing force exerted by the coil spring 15 to return to the reference position. When the slider 8 returns to the reference position from the most retreated position, the movable member 17 which is moved forward with the forward movement of the slider 8 is operative to carry the sham bullet BB held in the upper end portion of the magazine 31 to the bullet holding chamber 4 to be put in the same. Further, the gas passage controller 51 having been put in the front position is moved backward against the energizing force exerted by the coil spring 52 by means of the flow straightener 51C having its front end portion coming into contact with the shame bullet BB put in the bullet holding chamber 4 to be shifted to the rear position, as shown in FIG. 2.

As describe above, the hammer 5 is rotated in the b direction to the cocked position by the slider 8 moving backward to the most retreated position, the trigger 1 returns to the operational initial position immediately after the slider 8 returns, together with the movable member 17, to the reference position, and the hammer 5 is subjected to the positional restriction in the cocked position by the movable bar member 11 and the rotary lever 26, so that such a condition as shown in FIG. 3 is established again for making a preparation for shooting the next sham bullet BB.

In the first embodiment explained above and shown in FIGS. 1 and 2, the slider 8 operates appropriately and thereby the movable member 17 is operative properly to supply the bullet holding chamber 4 with the sham bullet BB in both of the case where the pressure of gas acting on the gas flow limiting member 44 is reduced to have the value less than the predetermined value under the influence of the relatively low atmospheric temperature, such as less than 20° C., and the case where the pressure of gas acting on the gas flow limiting member 44 is increased to have the value equal to or more than the predetermined value under the influence of the relatively high atmospheric temperature, for example, a case where the pressure of gas acting on the gas flow limiting member 44 is increased to have a extremely large value under the influence of the high atmospheric temperature, such as more than 35° C. Accordingly, with the first embodiment, the range of the atmospheric temperature in which appropriate operations can be obtained is effectively enlarged.

Although, in the first embodiment shown in FIGS. 1 and 2, the fixed member 50 provided in the movable member 17 for constituting, together with the gas flow limiting member 44, the gas flow adjusting mechanism, is formed to have the cone-shaped portion coming into the third gas passage 48 in the cylindrical portion 46 of the gas flow limiting member 44, it should be understood that the part of the fixed member 50 is not limited to be formed into the cone-shaped portion but possible to be formed into any shape for being operative to reduce and increase selectively the area of opening of a gas passage formed in the cylindrical portion 46 of the gas flow limiting member 44.

Figure 14:
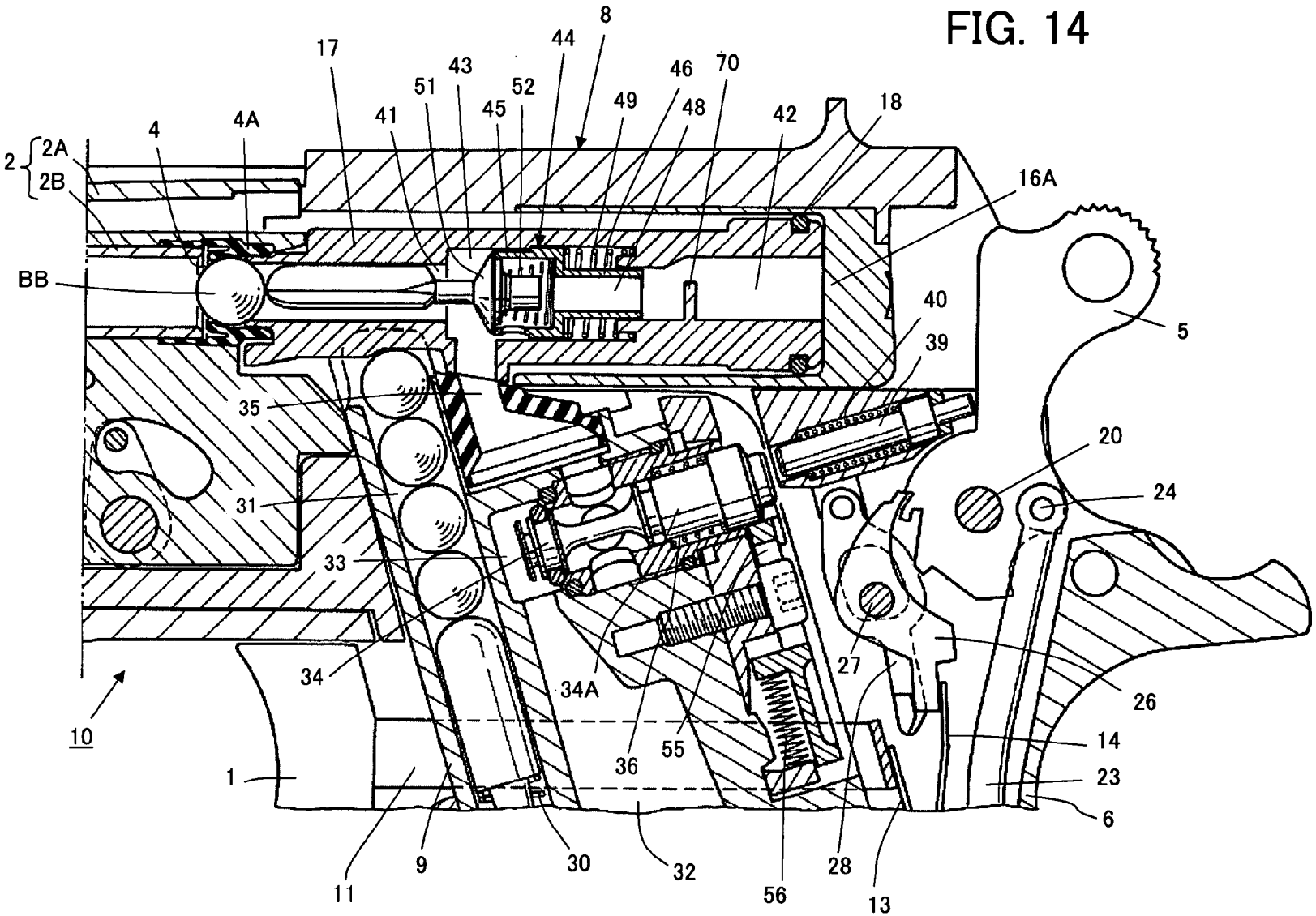
FIG. 14 is a partial cross sectional view showing a second embodiment of gas powered toy gun according to the present invention.

FIG. 14 shows a second embodiment of gas powered toy gun according to the present invention.

The second embodiment shown in FIG. 14 corresponds to a modification of the first embodiment shown in FIGS. 1 and 2, in which a fixed member 70 is provided instead of the fixed member 50 constituting, together with the gas flow limiting member 44, the gas flow adjusting mechanism in the first embodiment. In FIG. 14, various portions and members corresponding to those in the first embodiment shown in FIGS. 1 and 2 are marked with the same references and further description thereof will be omitted.

Referring to FIG. 14, the fixed member 70 is incorporated with a movable member 17 to be positioned behind a gas flow limiting member 44 in the movable member 17. The fixed member 70 is shaped into a plate planted in the movable member 17 to form a wall opposite to a rear end of a cylindrical portion 46 of the gas flow limiting member 44 (an opening of a third gas passage 48). A gas passage through which gas led through the third gas passage 48 and a second gas passage 42 to a pressure receiving portion 16A flows is formed above the fixed member 70 and the amount of the gas flowing through the gas passage formed above the fixed member 70 is limited by the rear end of the cylindrical portion 46 of the gas flow limiting member 44 and the fixed member 70.

When the gas flow limiting member 44 which is movable in the movable member 17 moves toward the pressure receiving portion 16A and the rear end of the cylindrical portion 46 of the gas flow limiting member 44 comes close to or comes into contact with the fixed member 70, the rear end of the cylindrical portion 46, namely, the opening of the third gas passage 48 is partially closed by the fixed member 70 so that the amount of gas flowing through the third gas passage 48 is limited by the rear end of the cylindrical portion 46 and the fixed member 70. Accordingly, the gas flow limiting member 44 and the fixed member 70 constitute a gas flow adjusting mechanism for adjusting the amount of gas flowing through the third gas passage 48 and the second gas passage 42 to the pressure receiving portion 16A.

In the second embodiment thus provided with the gas flow adjusting mechanism constituted with the gas flow limiting member 44 and the fixed member 70, as shown in FIG. 14, an initial operation is performed in the same manner as the initial operation performed in the first embodiment shown in FIGS. 1 and 2.

After a sham bullet BB has been supplied to a bullet holding chamber 4 by the initial operation, as shown in FIG. 14, when a trigger 1 is pulled, a bullet supplying mechanism including a hammer 5 operates in the same manner as the bullet supplying mechanism in the first embodiment shown in FIGS. 1 and 2. With the operation of the bullet supplying mechanism, gas discharged from a pressure accumulating chamber 32 is supplied through a gas leading passage constituted with lower and upper gas passages 33 and 35 and a connecting gas passage 43 to a first gas passage 41. Then, the gas supplied to the first gas passage 41 exerts pressure of gas to the sham bullet BB put in the bullet holding chamber 4, and thereby, the sham bullet BB put in the bullet holding chamber 4 is caused by the pressure of gas exerted thereto to move from the bullet holding chamber 4 into a barrel portion 2 so as to be shot from the bullet holding chamber 4.

Figure 15:
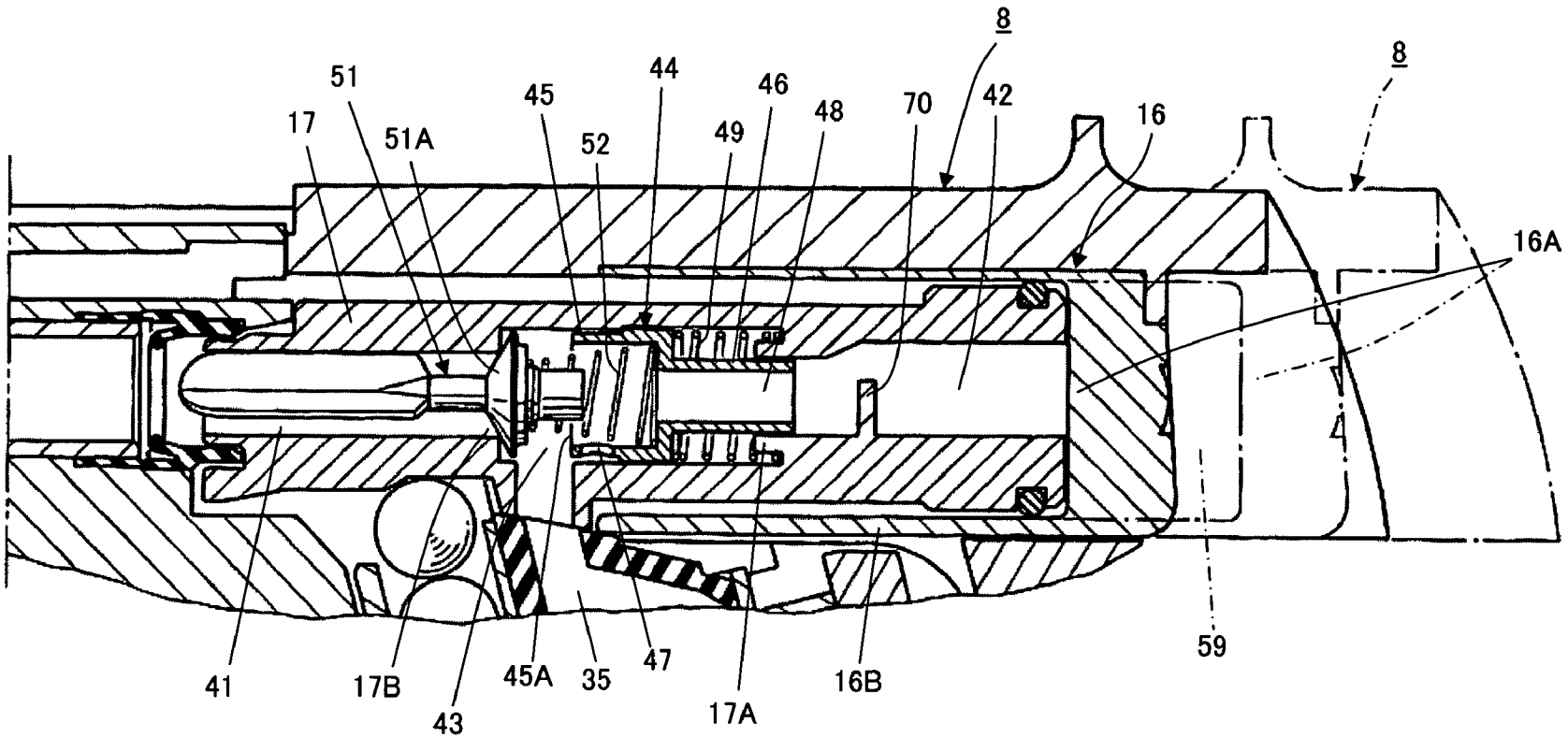
FIGS. 15 and 16 are partial cross sectional views used for explanation of the structure and operation of the second embodiment shown in FIG. 14.

The sham bullet BB shot from the bullet holding chamber 4 moves forward at a high speed in the barrel portion 2 and discharges from the muzzle provided on the barrel portion 2. With such movements of the sham bullet BB, the pressure of gas in the first gas passage 41 and the connecting gas passage 43 in the movable member 17 is reduced. As a result, a gas passage controller 51 is moved forward with energizing force exerted by a coil spring 52 to reach to a front position where a valve 51A apart from a bottomless cup-shaped portion 45 of the gas flow limiting member 44 is operative to close an opening 17B provided on the movable member 17 so that the first gas passage 41 is shifted to be closed, as shown in FIG. 15.

With the gas passage controller 51 thus put in the front position, the gas discharged from the pressure accumulating chamber 32 is supplied through the gas leading passage constituted with the lower and upper gas passages 33 and 35 and the connecting gas passage 43 formed in the movable member 17 to the third gas passage 48 formed in the cylindrical portion 46 of the gas flow limiting member 44. Under such a situation, pressure of gas against energizing force exerted by a coil spring 49 is exerted to the bottomless cup-shaped portion 45 of the gas flow limiting member 44 in the connecting gas passage 43.

The pressure of gas against the energizing force exerted by the coil spring 49 thus acting on the gas flow limiting member 44 varies in its value in response to variations in atmospheric temperature around the second embodiment shown in FIG. 14. For example, when the atmospheric temperature is less than 35° C., the pressure of gas against the energizing force exerted by the coil spring 49 acting on the gas flow limiting member 44 has a value less than a predetermined value, and when the atmospheric temperature is equal to or more than 35° C., the pressure of gas against the energizing force exerted by the coil spring 49 acting on the gas flow limiting member 44 has a value equal to or more than the predetermined value.

When the pressure of gas against the energizing force exerted by the coil spring 49 acting on the gas flow limiting member 44 has the value less than the predetermined value, the coil spring 49 is put in an elongated state for keeping the gas flow limiting member 44 in the reference position, as shown in FIG. 14. With the gas flow limiting member 44 put in the reference position, a relatively large space is made between the rear end of the cylindrical portion 46 of the gas flow limiting member 44 and the fixed member 70 and the rear end of the cylindrical portion 46, namely, the opening of the third gas passage 48 is not closed by the fixed member 70, as shown in FIG. 15. Consequently, the amount of gas flowing through the third gas passage 48 and the second gas passage 42 including the gas passage formed above the fixed member 70 to the pressure receiving portion 16A is relatively large.

On the other hand, when the pressure of gas against the energizing force exerted by the coil spring 49 acting on the gas flow limiting member 44 has the value equal to or more than the predetermined value, the coil spring 49 is operative to move the gas flow limiting member 44 from the reference position toward the pressure receiving portion 16A and thereby the rear end of the cylindrical portion 46 of the gas flow limiting member 44 comes close to or comes into contact with the fixed member 70 so that the rear end of the cylindrical portion 46, namely, the opening of the third gas passage 48 is partially closed by the fixed member 70. Consequently, the amount of gas flowing through the third gas passage 48 and the second gas passage 42 including the gas passage formed above the fixed member 70 to the pressure receiving portion 16A is reduced to be relatively small.

When the pressure of gas against the energizing force exerted by the coil spring 49 acting on the gas flow limiting member 44 has the value less than the predetermined value and therefore the gas flow limiting member 44 is put in the reference position, as shown in FIG. 15, so that the amount of gas flowing through the third gas passage 48 and the second gas passage 42 including the gas passage formed above the fixed member 70 to the pressure receiving portion 16A is relatively large, the pressure of gas acting on the pressure receiving portion 16A is suddenly increased with the gas of the relatively large amount having the pressure value less than the predetermined value. Consequently, the pressure receiving portion 16A is rapidly moved backward with the pressure of gas suddenly increased so that a pressure chamber 59 having variable capacity formed between a rear end of the movable member 17 and the pressure receiving portion 16A in the cup-shaped member 16 is rapidly enlarged, as shown with dot-dash lines in FIG. 15. With this rapid backward movement of the pressure receiving portion 16A, a slider 8 having been put in the reference position is rapidly moved backward against energizing force exerted by a coil spring corresponding to the coil spring 15 shown in FIG. 1.

Figure 16:
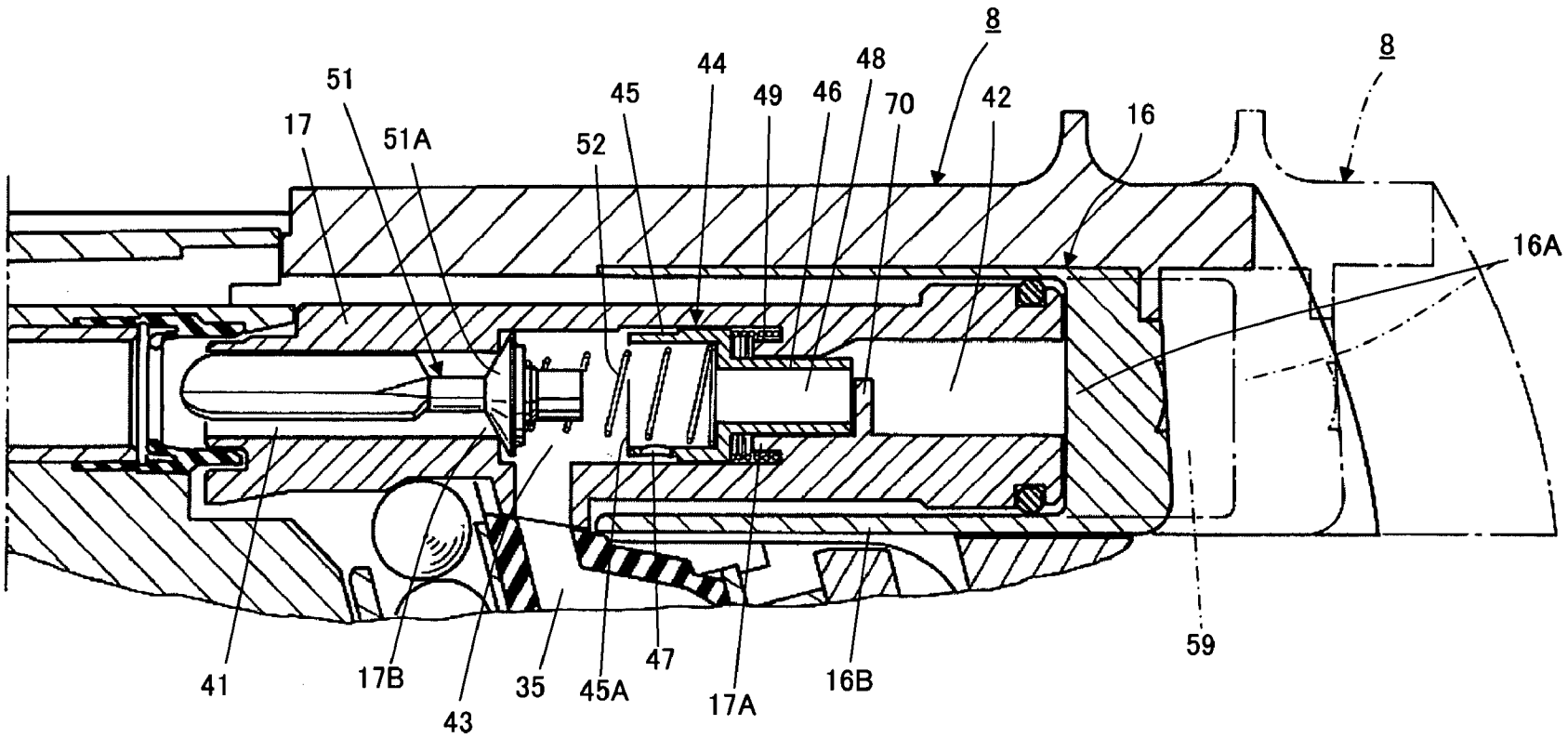

When the pressure of gas against the energizing force exerted by the coil spring 49 acting on the gas flow limiting member 44 has the value equal to or more than the predetermined value and therefore the gas flow limiting member 44 is moved backward from the reference position to such a position as shown in FIG. 16 so that the amount of gas flowing through the third gas passage 48 and the second gas passage 42 including the gas passage formed above the fixed member 70 to the pressure receiving portion 16A is reduced to be relatively small, the pressure of gas acting on the pressure receiving portion 16A is suddenly increased with the gas of the reduced amount having the pressure value equal to or more than the predetermined value. Consequently, the pressure receiving portion 16A is rapidly moved backward with the pressure of gas suddenly increased so that the pressure chamber 59 having variable capacity formed between a rear end of the movable member 17 and the pressure receiving portion 16A in the cup-shaped member 16 is rapidly enlarged, as shown with dot-dash lines in FIG. 16. With this rapid backward movement of the pressure receiving portion 16A, the slider 8 having been put in the reference position is rapidly moved backward against the energizing force exerted by the coil spring corresponding to the coil spring 15 shown in FIG. 1.

As described above, when the pressure of gas acting on the gas flow limiting member 44 has the value less than the predetermined value, the gas with which the pressure of gas having the relatively small value is applied to the gas flow limiting member 44 flows with the relatively large amount through the second gas passage 42 including the gas passage formed above the fixed member 70 to the pressure receiving portion 16A so that sufficient pressure of gas acts on the pressure receiving portion 16A. Consequently, the slider 8 is moved backward with the pressure of gas acting on the pressure receiving portion 16A at an appropriate speed with which the pressure chamber 59 having variable capacity is rapidly and surely enlarged, as shown with the dot-dash lines in FIG. 15.

Further, when the pressure of gas acting on the gas flow limiting member 44 has the value equal to or more than the predetermined value, the gas with which the pressure of gas having the relatively large value is applied to the gas flow limiting member 44 flows with the amount reduced enough through the second gas passage 42 including the gas passage formed above the fixed member 70 to the pressure receiving portion 16A so that sufficient pressure of gas acts on the pressure receiving portion 16A. Consequently, the slider 8 is moved backward with the pressure of gas acting on the pressure receiving portion 16A at an appropriate speed with which the pressure chamber 59 having variable capacity is rapidly and surely enlarged, without moving back at an excessive high speed, as shown with the dot-dash lines in FIG. 16.

As describer above, in the second embodiment shown in FIG. 14 also, the slider 8 moving backward at the appropriate speed is caused with inertia to reach to the most retreated position surely without bringing about excessive mechanical shock in the same manner as the slider 8 in the first embodiment shown in FIGS. 1 and 2.

In addition to the backward movement of the slider 8 from the reference position to the most retreated position, forward movement of the slider 8 from the most retreated position to the reference position, movements of the movable member 17 carried out together with the movements of the slider 8 and operations of the gas supplying mechanism including the hammer 5 are performed also in the same manner as those in the first embodiment shown in FIGS. 1 and 2.

In the second embodiment explained above and shown in FIG. 14, the slider 8 operates appropriately and thereby the movable member 17 is operative properly to supply the bullet holding chamber 4 with the sham bullet BB even in the case where the pressure of gas acting on the gas flow limiting member 44 is increased to have the relatively large value under the influence of the relatively high atmospheric temperature, such as more than 35° C. Accordingly, with the second embodiment, the range of the atmospheric temperature in which appropriate operations can be obtained is effectively enlarged.

The size and shape of the fixed member 70 should be selected to be suitable for closing partially the rear end of the cylindrical portion 46, namely, the opening of the third gas passage 48 when the rear end of the cylindrical portion 46 of the gas flow limiting member 44 comes close to or comes into contact with the fixed member 70.

Figure 17:
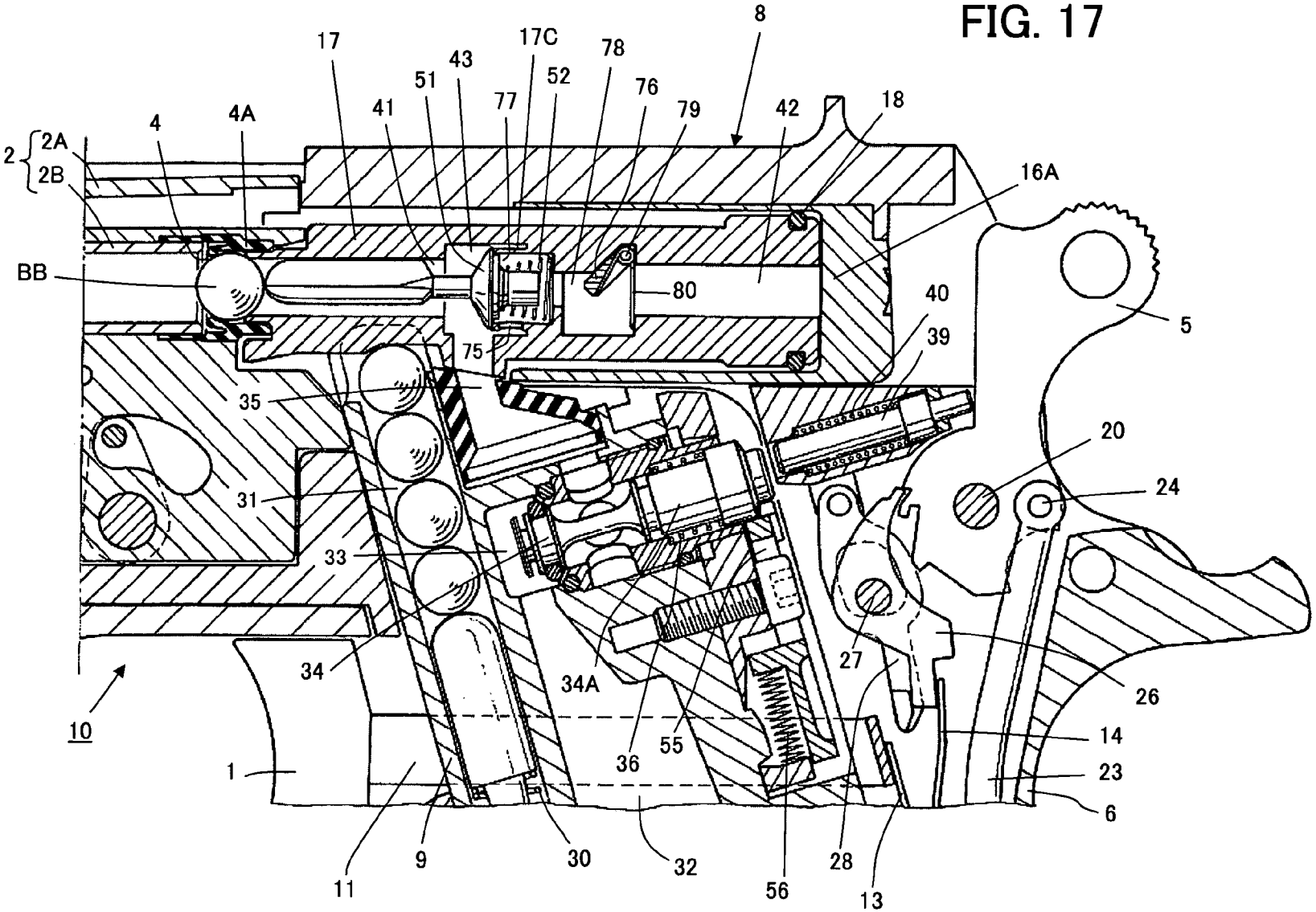
FIG. 17 is a partial cross sectional view showing a third embodiment of gas powered toy gun according to the present invention.

FIG. 17 shows a third embodiment of gas powered toy gun according to the present invention.

The third embodiment shown in FIG. 17 corresponds to a modification of the first embodiment shown in FIGS. 1 and 2, in which a bottomless cup-shaped portion 17C having an opening 75 is provided on a movable member 17 instead of the circular contacting portion 17A provided on the movable member 17 in the first embodiment and a gas flow adjusting mechanism including a movable gas passage controlling member 76 is provided instead of the gas flow adjusting mechanism constituted with the gas flow limiting member 44 and the fixed member 50 in the first embodiment.

In FIG. 17, various portions and members corresponding to those in the first embodiment shown in FIGS. 1 and 2 are marked with the same references and further description thereof will be omitted.

Referring to FIG. 14, in an inner space formed in the movable member 17, a coil spring 52 operative to force a gas passage controller 51 to be put in tendency of moving forward is provided in the bottomless cup-shaped portion 17C of the movable member 17. Under a condition where a sham bullet BB is put in a bullet holding chamber 4 and the gas passage controller 51 is put in a rear position, a valve 51A of the gas passage controller 51 closes an opening 77 of the bottomless cup-shaped portion 17C.

The movable gas passage controlling member 76 is attached to be swingable with an axis 79 to the movable member 17 in a connecting space 78 formed between a connecting gas passage 43 and a second gas passage 42 in the movable member 17. A toggle spring 80 is mounted on the axis 79 for forcing the movable gas passage controlling member 76 to be put in tendency of rotating clockwise in FIG. 17. The movable gas passage controlling member 76 thus provided is normally put in a reference position to be apart from an opening end of the second gas passage 42 facing the connecting space 78, as shown in FIG. 17.

The movable gas passage controlling member 76 is shaped into a plate in the aggregate. A gas passage through which gas led through the connecting gas passage 43, the connecting space 78 and the second gas passage 42 to a pressure receiving portion 16A flows is formed below the movable gas passage controlling member 76 and the movable gas passage controlling member 76 is operative to control this gas passage so as to limit the amount of the gas flowing through the same gas passage.

When the movable gas passage controlling member 76 is swung from the reference position shown in FIG. 17 toward the second gas passage 42 against energizing force exerted by the toggle spring 80, the opening end of the second gas passage 42 facing the connecting space 78 is partially closed by the movable gas passage controlling member 76 and thereby the amount of gas flowing through the second gas passage 42 is limited. Accordingly, the movable gas passage controlling member 76 constitutes a gas flow adjusting mechanism for adjusting the amount of gas flowing through the connecting gas passage 43, the connecting space 78 and the second gas passage 42 to the pressure receiving portion 16A.

In the third embodiment thus provided with the gas flow adjusting mechanism including the movable gas passage controlling member 76, as shown in FIG. 17, an initial operation is performed in the same manner as the initial operation performed in the first embodiment shown in FIGS. 1 and 2.

After the sham bullet BB has been supplied to the bullet holding chamber 4 by the initial operation, as shown in FIG. 17, when a trigger 1 is pulled, a bullet supplying mechanism including a hammer 5 operates in the same manner as the bullet supplying mechanism in the first embodiment shown in FIGS. 1 and 2. With the operation of the bullet supplying mechanism, gas discharged from a pressure accumulating chamber 32 is supplied through a lower gas passage made open by a movable valve 34, an upper gas passage 35 and the connecting gas passage 43 to a first gas passage 41. Then, the gas supplied to the first gas passage 41 exerts pressure of gas to the sham bullet BB put in the bullet holding chamber 4, and thereby, the sham bullet BB put in the bullet holding chamber 4 is caused by the pressure of gas exerted thereto to move from the bullet holding chamber 4 into a barrel portion 2 so as to be shot from the bullet holding chamber 4.

Figure 18:
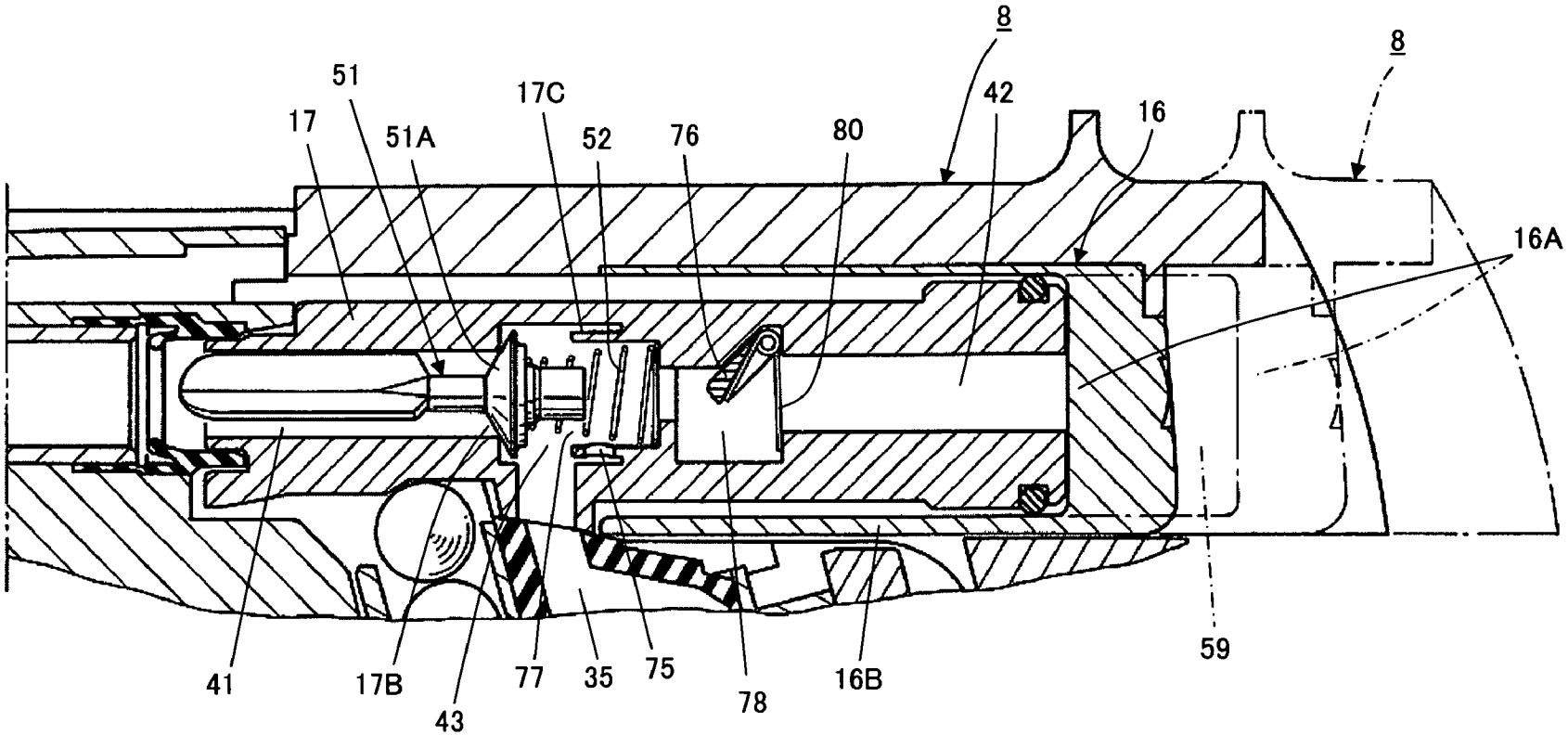
FIGS. 18 and 19 are partial cross sectional views used for explanation of the structure and operation of the third embodiment shown in FIG. 17.

The sham bullet BB shot from the bullet holding chamber 4 moves forward at a high speed in the barrel portion 2 and discharges from the muzzle provided on the barrel portion 2. With such movements of the sham bullet BB, the pressure of gas in the first gas passage 41 and the connecting gas passage 43 in the movable member 17 is reduced. As a result, the gas passage controller 51 is moved forward with energizing force exerted by the coil spring 52 to reach to a front position where the valve 51A apart from a bottomless cup-shaped portion 17C of the movable member 17 is operative to close an opening 17B provided on the movable member 17 so that the first gas passage 41 is shifted to be closed, as shown in FIG. 18.

With the gas passage controller 51 thus put in the front position, the gas discharged from the pressure accumulating chamber 32 is supplied through a gas leading passage constituted with the lower gas passage made open by the movable valve 34 and the upper gas passage 35 and the connecting gas passage 43 in the movable member 17 to the connecting space 78 formed in the movable member 17. Under such a situation, pressure of gas against the energizing force exerted by the toggle spring 80 acts on the movable gas passage controlling member 76.

The pressure of gas against the energizing force exerted by the toggle spring 80 thus acting on the movable gas passage controlling member 76 varies in its value in response to variations in atmospheric temperature around the third embodiment shown in FIG. 17. For example, when the atmospheric temperature is less than 35° C., the pressure of gas against the energizing force exerted by the toggle spring 80 acting on the movable gas passage controlling member 76 has a value less than a predetermined value, and when the atmospheric temperature is equal to or more than 35° C., the pressure of gas against the energizing force exerted by the toggle spring 80 acting on the movable gas passage controlling member 76 has a value equal to or more than the predetermined value.

When the pressure of gas against the energizing force exerted by the toggle spring 80 acting on the movable gas passage controlling member 76 has the value less than the predetermined value, the toggle spring 80 is operative to keep the movable gas passage controlling member 76 in the reference position, as shown in FIG. 17. With the movable gas passage controlling member 76 put in the reference position to be apart from the opening end of the second gas passage 42 facing the connecting space 78, the opening end of the second gas passage 42 facing the connecting space 78 is not closed by the movable gas passage controlling member 76, as shown in FIG. 18. Consequently, the amount of gas flowing through the connecting gas passage 43, the connecting space 78 and the second gas passage 42 to the pressure receiving portion 16A is relatively large.

Figure 19:
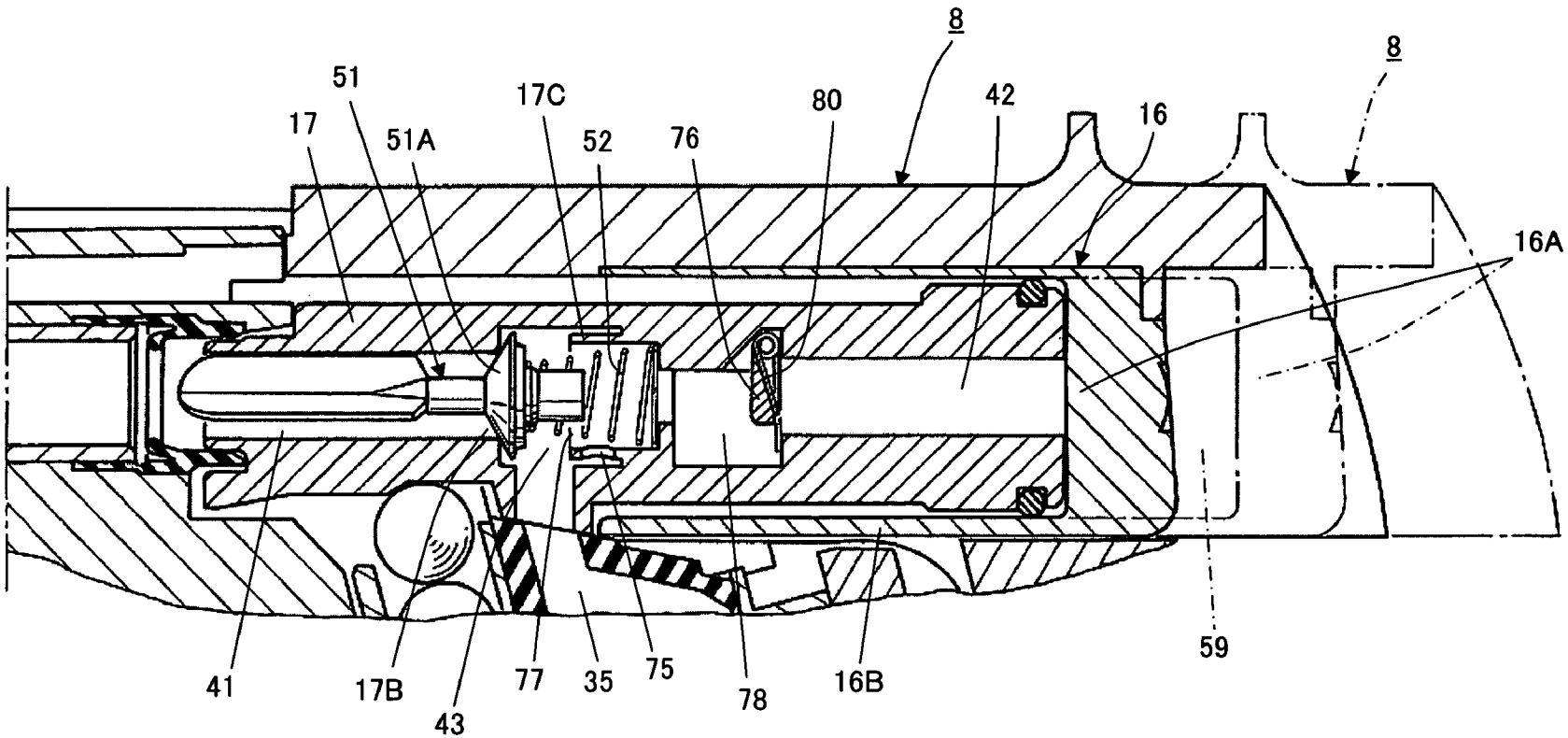

On the other hand, when the pressure of gas against the energizing force exerted by the toggle spring 80 acting on the movable gas passage controlling member 76 has the value equal to or more than the predetermined value, the movable gas passage controlling member 76 is swung from the reference position shown in FIG. 17 to the opening end of the second gas passage 42 facing the connecting space 78 against the energizing force exerted by the toggle spring 80 and thereby the opening end of the second gas passage 42 facing the connecting space 78 is partially closed by the movable gas passage controlling member 76, as shown in FIG. 19. Consequently, the amount of gas flowing through the connecting gas passage 43, the connecting space 78 and the second gas passage 42 to the pressure receiving portion 16A is reduced to be relatively small.

When the pressure of gas acting on the movable gas passage controlling member 76 has the value less than the predetermined value and therefore the movable gas passage controlling member 76 is put in the reference position, as shown in FIG. 17, so that the amount of gas flowing through the connecting gas passage 43, the connecting space 78 and the second gas passage 42 to the pressure receiving portion 16A is relatively large, the pressure of gas acting on the pressure receiving portion 16A is suddenly increased with the gas of the relatively large amount having the pressure value less than the predetermined value. Consequently, the pressure receiving portion 16A is rapidly moved backward with the pressure of gas suddenly increased so that a pressure chamber 59 having variable capacity formed between a rear end of the movable member 17 and the pressure receiving portion 16A in a cup-shaped member 16 is rapidly enlarged, as shown with dot-dash lines in FIG. 18. With this rapid backward movement of the pressure receiving portion 16A, a slider 8 having been put in the reference position is rapidly moved backward against energizing force exerted by a coil spring corresponding to the coil spring 15 shown in FIG. 1.

When the pressure of gas acting on the movable gas passage controlling member 76 has the value equal to or more than the predetermined value and therefore the movable gas passage controlling member 76 is moved from the reference position to such a position as shown in FIG. 19 so that the amount of gas flowing through the connecting gas passage 43, the connecting space 78 and the second gas passage 42 to the pressure receiving portion 16A is reduced to be relatively small, the pressure of gas acting on the pressure receiving portion 16A is suddenly increased with the gas of the reduced amount having the pressure value equal to or more than the predetermined value. Consequently, the pressure receiving portion 16A is rapidly moved backward with the pressure of gas suddenly increased so that the pressure chamber 59 having variable capacity formed between a rear end of the movable member 17 and the pressure receiving portion 16A in the cup-shaped member 16 is rapidly enlarged, as shown with dot-dash lines in FIG. 19. With this rapid backward movement of the pressure receiving portion 16A, the slider 8 having been put in the reference position is rapidly moved backward against the energizing force exerted by the coil spring corresponding to the coil spring 15 shown in FIG. 1.

As described above, when the pressure of gas acting on the movable gas passage controlling member 76 has the value less than the predetermined value, the gas with which the pressure of gas having the relatively small value is applied to the movable gas passage controlling member 76 flows with the relatively large amount through a gas passage formed below the movable gas passage controlling member 76 and the second gas passage 42 to the pressure receiving portion 16A so that sufficient pressure of gas acts on the pressure receiving portion 16A. Consequently, the slider 8 is moved backward with the pressure of gas acting on the pressure receiving portion 16A at an appropriate speed with which the pressure chamber 59 having variable capacity is rapidly and surely enlarged, as shown with the dot-dash lines in FIG. 18.

Further, when the pressure of gas acting on the movable gas passage controlling member 76 has the value equal to or more than the predetermined value, the gas with which the pressure of gas having the relatively large value is applied to the movable gas passage controlling member 76 flows with the amount reduced enough through the gas passage formed below the movable gas passage controlling member 76 and the second gas passage 42 to the pressure receiving portion 16A so that sufficient pressure of gas acts on the pressure receiving portion 16A. Consequently, the slider 8 is moved backward with the pressure of gas acting on the pressure receiving portion 16A at an appropriate speed with which the pressure chamber 59 having variable capacity is rapidly and surely enlarged, without moving back at an excessive high speed, as shown with the dot-dash lines in FIG. 19.

As describer above, in the third embodiment shown in FIG. 17 also, the slider 8 moving backward at the appropriate speed is caused with inertia to reach to the most retreated position surely without bringing about excessive mechanical shock in the same manner as the slider 8 in the first embodiment shown in FIGS. 1 and 2.

In addition to the backward movement of the slider 8 from the reference position to the most retreated position, forward movement of the slider 8 from the most retreated position to the reference position, movements of the movable member 17 carried out together with the movements of the slider 8 and operations of the gas supplying mechanism including the hammer 5 are performed also in the same manner as those in the first embodiment shown in FIGS. 1 and 2.

In the third embodiment explained above and shown in FIG. 17, the slider 8 operates appropriately and thereby the movable member 17 is operative properly to supply the bullet holding chamber 4 with the sham bullet BB even in the case where the pressure of gas acting on the movable gas passage controlling member 76 is increased to have the relatively large value under the influence of the relatively high atmospheric temperature, such as more than 35° C. Accordingly, with the third embodiment, the range of the atmospheric temperature in which appropriate operations can be obtained is effectively enlarged.

The size and shape of the movable gas passage controlling member 76 should be selected to be suitable for closing partially the opening end of the second gas passage 42 facing the connecting space 78 when the movable gas passage controlling member 76 is swung from the reference position to the opening end of the second gas passage 42 facing the connecting space 78.

What is claimed is:

1. A gas powered toy gun comprising:

a gas supplying portion from which a gas leading passage extends;

a valve for controlling the gas leading passage to be open and closed selectively;

a slider provided to be movable along a barrel portion connected with a bullet holding chamber in which a sham bullet is put, and provided with a pressure receiving portion fixed to be positioned at a back of the barrel portion for moving backward in order to supply the bullet holding chamber with the sham bullet;

a movable member having an inner space formed therein and provided to be movable in the slider so as to be put selectively in a first state wherein the inner space is coupled with the gas leading passage and in a second state wherein the inner space is removed from the gas leading passage;

a gas passage controller provided to be movable in the inner space and operative to guide gas flowing through the gas leading passage to the bullet holding chamber through the inner space so that the sham bullet put in the bullet holding chamber is shot with gas pressure acting thereon and to guide further the gas flowing through the gas leading passage to the pressure receiving portion through the inner space so that the slider is moved backward with gas pressure acting on the pressure receiving portion in the first state when the valve is operative to control the gas leading passage to be open; and gas flow adjusting means provided in the inner space formed in the movable member for adjusting the amount of gas flowing through the inner space to the pressure receiving portion in response to pressure of gas led into the inner space through the gas leading passage by the gas passage controller, wherein the gas passage controller moves relative to the gas flow adjusting means to control gas flow between the gas leading passage and the gas flow adjusting means, wherein said gas flow adjusting means is operative to limit the amount of gas flowing through the inner space to the pressure receiving portion when the pressure of gas led into the inner space through the gas leading passage has a value not less than a predetermined value, wherein said gas flow adjusting means comprises:

a fixed member provided in a part of the inner space through which the gas flows when flowing to the pressure receiving portion; and a gas flow limiting member provided to be selectively movable in the inner space relative to the fixed member and the pressure receiving portion, wherein said gas flow limiting member is forced by a force exerted by a resilient member to be put in a tendency of moving away from the pressure receiving portion and moved with a gas pressure acting thereon to move close to the pressure receiving portion against the force exerted by the resilient member so that the amount of gas flowing to the pressure receiving portion is limited by the gas flow limiting member and the fixed member when the pressure of gas led into the inner space has the value not less than the predetermined value.

2. A gas powered toy gun according to claim 1, wherein said fixed member is fixed to the movable member in which the inner space is formed.

* * * * *